US010634431B2

(12) United States Patent
Shiozawa et al.

(10) Patent No.: US 10,634,431 B2
(45) Date of Patent: Apr. 28, 2020

(54) STRUCTURE OF HEAT EXCHANGER CORE WITHOUT HEADER PLATE

(71) Applicant: T.RAD Co., Ltd., Shibuya-ku, Tokyo (JP)

(72) Inventors: Kensuke Shiozawa, Tokyo (JP); Yoshihiko Sasaki, Tokyo (JP); Tsutomu Wada, Tokyo (JP); Atsushi Okubo, Tokyo (JP); Yasushi Yoshino, Tokyo (JP)

(73) Assignee: T.RAD Co., Ltd., Tokyo (JP)

( * ) Notice: Subject to any disclaimer, the term of this patent is extended or adjusted under 35 U.S.C. 154(b) by 128 days.

(21) Appl. No.: 15/770,663

(22) PCT Filed: Oct. 21, 2016

(86) PCT No.: PCT/JP2016/082193
§ 371 (c)(1),
(2) Date: Apr. 24, 2018

(87) PCT Pub. No.: WO2017/073779
PCT Pub. Date: May 4, 2017

(65) Prior Publication Data

US 2018/0320975 A1 Nov. 8, 2018

(30) Foreign Application Priority Data

Oct. 29, 2015 (JP) ..... 2015-213109

(51) Int. Cl.
*F28D 1/047* (2006.01)
*F28F 3/02* (2006.01)
(Continued)

(52) U.S. Cl.
CPC ..... *F28D 1/047* (2013.01); *F28D 7/16* (2013.01); *F28D 9/0043* (2013.01); *F28F 1/02* (2013.01);
(Continued)

(58) Field of Classification Search
CPC ... F28D 1/02; F28D 1/047; F28D 7/16; F28D 7/1692; F28D 9/0037; F28D 21/00;
(Continued)

(56) References Cited

U.S. PATENT DOCUMENTS 4,681,155 A * 7/1987 Kredo ..... F28F 3/025 138/163
4,738,308 A * 4/1988 Moranne ..... F28D 1/05333 165/149
(Continued)

FOREIGN PATENT DOCUMENTS

FR 2968753 A1 6/2012
JP 2011-232020 A 11/2011
(Continued)

*Primary Examiner* — Keith M Raymond
*Assistant Examiner* — Gustavo A Hincapie Serna
(74) *Attorney, Agent, or Firm* — Norris McLaughlin, P.A.

(57) ABSTRACT

To provide a structure of a heat exchanger core that enables the outer periphery of an stacked body 8 including an assembly of flat tubes to be held in a previously fastened state and is excellent in mass-productivity, external frame portions of a pair of frame bodies are fitted onto both ends of a bulging portion of the stacked body of the flat tubes, and, in the state where the stacked body is restrained, a casing is additionally fitted onto the outer periphery of the stacked body.

11 Claims, 17 Drawing Sheets

(51) Int. Cl.

| | |
|---|---|
| ***F28F 9/02*** | (2006.01) |
| ***F28D 7/16*** | (2006.01) |
| ***F28D 9/00*** | (2006.01) |
| ***F28F 9/00*** | (2006.01) |
| ***F28F 3/04*** | (2006.01) |
| ***F28F 1/02*** | (2006.01) |
| ***F28F 9/16*** | (2006.01) |
| ***F28F 3/06*** | (2006.01) |

(52) U.S. Cl.
CPC ..... *F28F 1/025* (2013.01); *F28F 3/025* (2013.01); *F28F 3/044* (2013.01); *F28F 3/046* (2013.01); *F28F 9/001* (2013.01); *F28F 9/002* (2013.01); *F28F 9/0221* (2013.01); *F28F 9/0278* (2013.01); *F28F 9/162* (2013.01); *F28F 3/06* (2013.01); *F28F 2001/027* (2013.01)

(58) Field of Classification Search
CPC ... F28D 21/0003; F02M 25/07; Y02T 10/122; F28F 1/02; F28F 3/086; F28F 9/00; F28F 9/002; F28F 9/02; F28F 9/026; F28F 9/0278; F28F 9/16; F28F 9/162; F28F 9/182; F28F 2009/029; F28F 2265/16; F28F 2265/26; F28F 2275/04; F28F 9/18
USPC ..... 165/157, 158, 162, 164, 166
See application file for complete search history.

(56) References Cited

U.S. PATENT DOCUMENTS

| | | | | |
|---|---|---|---|---|
| 8,844,504 | B2 * | 9/2014 | Raduenz | F28D 7/1684 123/568.12 |
| 8,925,624 | B2 * | 1/2015 | Kuroyanagi | F28D 7/1692 165/157 |
| 9,127,895 | B2 * | 9/2015 | Neher | F28D 7/1684 |
| 9,328,968 | B2 * | 5/2016 | Vanderwees | F28D 9/005 |
| 9,377,252 | B2 * | 6/2016 | Garret | F28F 9/0219 |
| 9,599,412 | B2 * | 3/2017 | Garret | F28D 7/1684 |
| 9,951,677 | B2 * | 4/2018 | Bruggesser | F02B 29/0462 |
| 9,995,540 | B2 * | 6/2018 | Nakamura | F28F 9/0221 |
| 10,279,648 | B2 * | 5/2019 | Vallee | F28F 9/00 |
| 2006/0219394 | A1 * | 10/2006 | Martin | F28D 9/0043 165/157 |
| 2008/0135221 | A1 * | 6/2008 | Nakamura | F28D 9/0025 165/165 |
| 2008/0277108 | A1 | 11/2008 | Geskes | |
| 2008/0289804 | A1 * | 11/2008 | Baumann | F28D 7/1692 165/157 |
| 2009/0065184 | A1 * | 3/2009 | Miyagawa | F28D 9/0037 165/164 |
| 2010/0025024 | A1 * | 2/2010 | Meshenky | F28D 7/1684 165/164 |
| 2010/0319889 | A1 | 12/2010 | Ikeda | |
| 2011/0247318 | A1 | 10/2011 | Kuroyanagi et al. | |
| 2012/0138279 | A1 * | 6/2012 | Palanchon | F28D 7/1684 165/157 |
| 2014/0318109 | A1 * | 10/2014 | Yokoo | F01N 3/10 60/320 |
| 2015/0107809 | A1 * | 4/2015 | Dinulescu | F28D 9/0037 165/166 |
| 2015/0184952 | A1 | 7/2015 | Ignjatovic et al. | |
| 2016/0084583 | A1 * | 3/2016 | Maucher | F02M 25/0737 123/568.12 |
| 2017/0016684 | A1 | 1/2017 | Okubo et al. | |

FOREIGN PATENT DOCUMENTS

| | | | |
|---|---|---|---|
| JP | 2014-055711 | A | 3/2014 |
| JP | 2015-025649 | A | 2/2015 |
| JP | 2015-087090 | A | 5/2015 |
| JP | 2015-522790 | A | 8/2015 |
| WO | 2007/031306 | A1 | 3/2007 |
| WO | 2015/133592 | A1 | 9/2015 |

* cited by examiner

Fig.20 (A) PRIOR ART
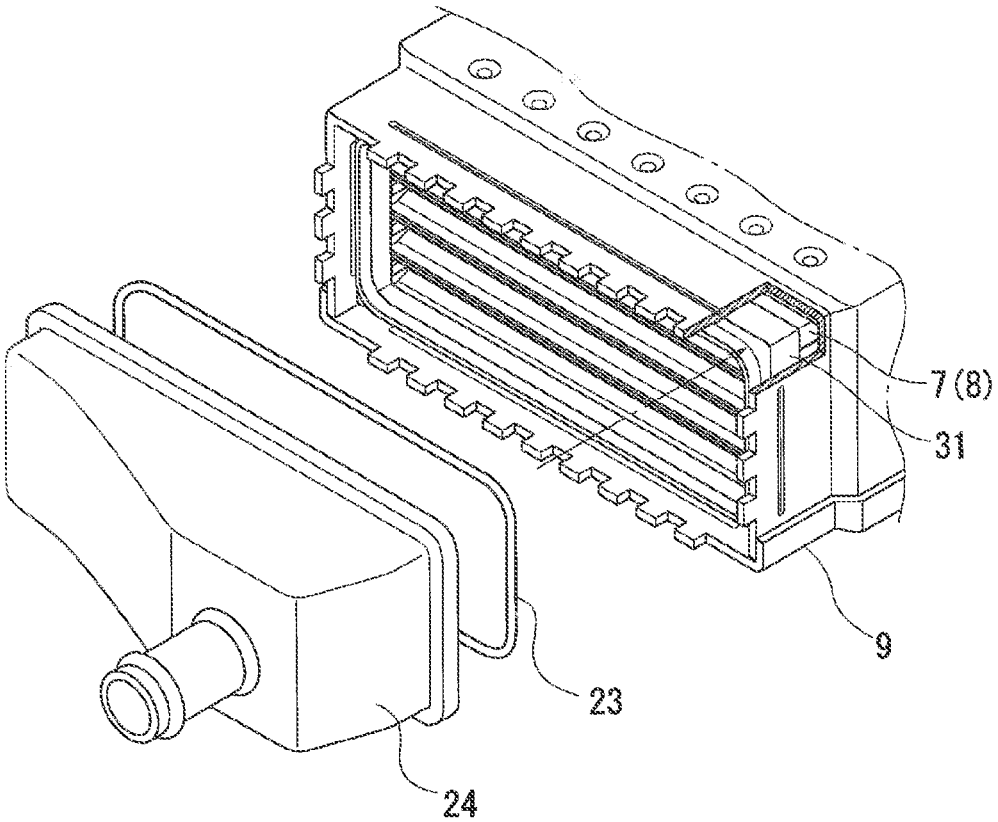
Fig.20 (B) PRIOR ART
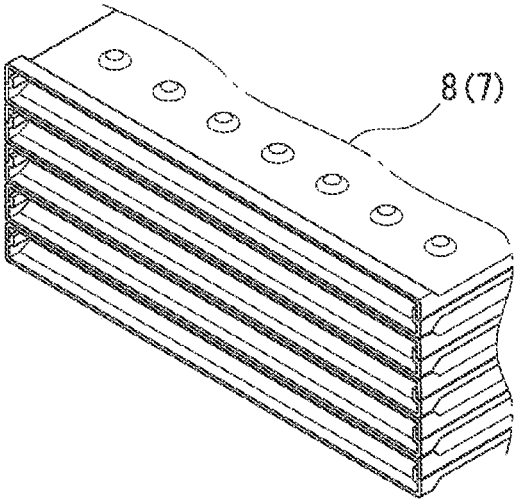

STRUCTURE OF HEAT EXCHANGER CORE WITHOUT HEADER PLATE

BACKGROUND OF THE INVENTION

The present invention relates to a structure of a heat exchanger core that does not use a header plate.

There is known a tank coupling structure of a heat exchanger without a header plate described in Japanese Patent Laid-open No. 2014-55711. In the structure, expansion parts are formed at both end portions on an opening side of a pair of plates formed into a groove shape, and the plates are superimposed in a reverse direction to configure a flat tube. Then, respective flat tubes are superimposed at the expansion parts to assemble a core of a heat exchanger without a header plate. Then, a casing is fitted onto the outer periphery of the core. Then, in a high temperature furnace, the core is integrally brazed and a tank is fitted onto both ends of the core to thereby complete a heat exchanger.

At this time, a stacked body 8 obtained by assembling the flat tubes 7 is formed as in FIG. 20(B), and, onto the outer periphery of the stacked body 8, a casing 9 is fitted as in FIG. 20(A). Then, between an opening end of the stacked body 8 and the casing 9, an annular groove is formed, and an edge part of a tank 24 is caulked and fixed thereto via a packing 23.

That is, as shown in FIG. 21, the casing 9 is fitted onto the outer periphery of the stacked body 8 including an assembly of the flat tubes 7, and, in the inside of the casing 9, a tip edge of the stacked body 8 impinges on the rear end of a bracket 31. Then, between a step part of the bracket 31 and the casing 9, a groove part is formed, into which the packing 23 is fitted, and a tip of the casing 9 is caulked to couple the tank 24.

SUMMARY OF THE INVENTION

In a case where a pair of plates are combined to form the flat tube 7, and the casing 9 is fitted onto the outer periphery of the flat tube 7 and a bracket 31 is arranged to the inside of the casing 9 to assemble respective components, positioning between respective components is extremely troublesome.

Consequently, the present invention aims at providing a structure of a heat exchanger core without a header plate that enables the outer periphery of an assembly of flat tubes 7 to be held in a previously fastened state and is excellent in mass-productivity.

A first aspect of the present invention is a structure of a heat exchanger core without a header plate, in which:

a pair of plates (5) and (6) having a pair of side walls (1) and (2) extended upward on both sides, respectively, to form a whole body into a groove shape, and bulging portions (4) formed at edges on both open sides of a groove bottom (3) on an outer side in a thickness direction orthogonally to the side walls (1) and (2) are fitted with each other facing in a reverse direction, to thereby form a flat tube (7); and a casing (9) is fitted onto an outer periphery of a stacked body (8) configured by stacking a plurality of the flat tubes (7) each other at the bulging portions (4), wherein:

an external frame portion (10) whose inner periphery matches with an outer periphery on a bulging portion (4) side of the stacked body (8), an inside flange portion (11) formed at a peripheral edge of the external frame portion (10), and a packing holding portion (12) extended upward in a side wall direction at an inner edge of the inside flange portion (11) constitute a frame body (13);

the external frame portion (10) of a pair of the frame bodies (13) are fitted onto both ends on a bulging portion (4) side of the stacked body (8) to grasp outer peripheries at both end portions of the stacked body (8) with the frame body (13), and the casing (9) is fitted onto an outer periphery of the external frame portion (10) of the frame body (13); and as a result, an annular groove (14) into which a packing for seal can be inserted is formed between a packing grasping portion (12) of the frame body (13) and both end edges of the casing (9).

A second aspect of the present invention is the structure of the heat exchanger core without a header plate according to the first aspect, wherein the bulging portion (4) of each of plates (5) and (6) includes:

width wide portions (4*a*) lying at both end portions in a longitudinal direction of the bulging portion (4), with a wide width in the side wall direction; and a width narrow portion (4*b*) lying between the width wide portions (4*a*), with a narrow width thereof.

A third aspect of the present invention is the structure of the heat exchanger core without a header plate according to the second aspect, wherein a length in a side wall direction of the width wide portion (4*a*) of the bulging portion (4) is longer than a width in a side wall direction of the external frame portion (10) of the frame body (13).

A fourth aspect of the present invention is the structure of the heat exchanger core without a header plate according to any of the first to third aspects, wherein:

between a pair of the bulging portions (4) on an outer face side of the flat tube (7), a partition portion (27) that is parallel to the bulging portion (4) and has the same height as the bulging portion (4) is formed;

the partition portion (27) is formed so as to reach an edge of one side of the side wall (1), and not to reach the other side of the side wall (2) but to end on this side of the side wall (2), and is formed so that a first fluid (32) on an outer face side of the flat tube (7) goes in a U-like shape around the partition portion (27); and in the flat tube (7), a fitting structure (a first fitting structure (28)) between side walls (1) on one side of a pair of the plates (5) and (6) composing the flat tube (7) is different from a fitting structure (a second fitting structure (29)) between side walls (2) on the other side to prevent a mismatch such that one side of the side wall (1) is combined with the other side of the side wall (2).

A fifth aspect of the present invention is the structure of the heat exchanger core without a header plate according to the fourth aspect, wherein the first fitting structure (28) between the side walls (1) on one side is formed, protruding in an M-like shape slightly outward in a plan view, and the second fitting structure (29) between the side walls (2) on the other side is formed, protruding in a mountain shape slightly outward in a plan view, i.e., outwardly bowed in plan view.

A sixth aspect of the present invention is the structure of the heat exchanger core without a header plate according to any of the first to fifth aspects, wherein the external frame portion (10) of the frame body (13) is prolonged in the side wall direction and a convex portion (34) for a stopper is formed on an inner periphery of the external frame portion (10), "stopper" meaning that the convex portion is configured to engage an outer peripheral portion of the stack to fix the frame on the stack, and the stacked body (8) is positioned at the convex portion (34).

a seventh aspect of the present invention is the structure of the heat exchanger core without a header plate according to any of the first to fifth aspects, wherein the structure is configured to have an end tongue piece portion (4*c*) protruding in the side wall direction from tips of both end portions in a longitudinal direction of the bulging portion (4) of each plate, to cause a tip of the end tongue piece portion (4*c*) to abut on the inside flange portion (11) to thereby form a room (36) between the bulging portion (4) and the inside flange portion (11), and to lead smoothly a second fluid (33) to an opening of each flat tube (7).

An eighth aspect of the present invention described in claim 8 is the structure of the heat exchanger core without a header plate according to the seventh aspect, wherein, at a middle position in a longitudinal direction of the bulging portion (4), a middle protruding portion (4*d*) protrudes in the side wall direction, and the middle protruding portion (4*d*) abuts on the inside flange portion (11).

A ninth aspect of the present invention is the structure of the heat exchanger core without a header plate according to the seventh aspect, wherein the convex portion (34) for a stopper is formed only on an inner periphery of a site matching with a middle portion in a longitudinal direction of the bulging portion (4) of the flat tube (7) in the external frame portion (10) of the frame body (13), and, on the convex portion (34), the middle part in a longitudinal direction of the bulging portion (4) of the flat tube (7) is abutted.

A tenth aspect of the present invention is the structure of the heat exchanger core without a header plate according to any of the first to ninth aspects, wherein an outer periphery of an end portion of the casing (9) has an expansion end portion (35) expanded in a stepped shape, the expansion end portion (35) is fitted onto an outer periphery of the external frame portion (10), and, excluding the expansion end portion (35), a space between an inner face of the casing (9) and a plate lying on the outermost side in a stacking direction of the stacked body (8) is kept to a thickness of the external frame portion (10).

An eleventh aspect of the present invention is the structure of the heat exchanger core without a header plate according to any of the first to tenth aspects, wherein respective components are brazed integrally in a high temperature furnace.

In the structure of the heat exchanger core of the present invention, the external frame portions 10 of a pair of the frame bodies 13 are fitted onto both ends on the bulging portion 4 side of the stacked body 8, the frame bodies 13 grasp outer peripheries of both end portions of the stacked body 8, the casing 9 is fitted onto outer peripheries of the external frame portions 10 of the frame bodies 13, and, between the packing grasping portion 12 of the frame body 13 and both end edges of the casing 9, the annular groove 14 into which a packing for seal can be inserted is formed.

According to the structure of the heat exchanger core of this invention, both end portions of the stacked body 8 of flat tubes 7 are integrally brought together by a pair of the frame bodies 13, and, in the state, the casing 9 is fitted onto the outer periphery of the external frame portion 10 of the frame body 13, and therefore the assembling of a heat exchanger core before brazing can be performed easily and precisely. Then, in a state where respective components are restrained one another, brazing can be performed quickly and easily.

In the above-described configuration, as the second aspect of the invention, in the case where the width wide portions 4*a* are formed at both end portions of the bulging portion 4 of each plate and, between the width wide portions 4*a*, the width narrow portion 4*b* is formed, corner portions of the flat tube 7 where brazing is particularly difficult can be surely joined to provide a heat exchanger core with high reliability. In addition, an end portion of an inner fin 17 inside the flat tube 7 can be arranged up to the width narrow portion 4*b* or the vicinity thereof, and brazing between the inner fin 17 and the plates 5, 6 can surely be performed.

In the above-described configuration, as the third aspect of the invention, in the case where the length in the side wall direction of the width wide portion 4*a* of the bulging portion 4 is set to be longer than the width in the side wall direction of the external frame portion 10 of the frame body 13, the reliability of brazing between the frame body 13 and the flat tube 7 can further be improved.

In the above-described configuration, as the fourth aspect of the invention, in the case where, between a pair of the bulging portions 4 on an outer face side of the flat tube 7, the partition portion 27 that is parallel to the bulging portion 4 and has the same height as the bulging portion 4 is formed, and the fitting structure (the first fitting structure 28) between the side walls 1 of one of a pair of the plates 5 and 6 configuring the flat tube 7 and the fitting structure (the second fitting structure 29) between the side walls 2 of the other one are made different from each other, a mismatch of assembling a side wall on one side and a side wall on the other side can be prevented.

In the above-described configuration, as the fifth aspect of the invention, in the case where the first fitting structure 28 between the side walls 1 on one side is formed into an M-like shape in a plan view and the second fitting structure 29 between the side walls 2 on the other side is formed into a mountain-like shape in a plan view, a mismatch of assembling side wall portions can be prevented furthermore surely.

In the above-described configuration, as the sixth aspect of the invention, in the case where the external frame portion 10 of the frame body 13 is prolonged in the side wall direction and the convex portion 34 for a stopper is formed on the inner periphery of the external frame portion 10, and the stacked body 8 is positioned with respect to the convex portion 34, an internal volume of the external frame portion 10 becomes large to enable a fluid to be led smoothly into the inside of each flat tube.

In the above-described configuration, as the seventh aspect of the invention, in the case where the end tongue piece portion 4*c* protruding in the side wall direction from the tip of the width wide portion 4*a* of the bulging portion 4 of each plate is present, and the tip of the end tongue piece portion 4*c* abuts on the inside flange portion 11 to form the room 36 between the width narrow portion 4*b* of the bulging portion 4 and the inside flange portion 11, the second fluid 33 can be led smoothly into the inside of each flat tube.

In the above-described configuration, as the eighth aspect of the invention, in the case where the middle protruding portion 4*d* is protruded toward the side wall direction at a middle position in the longitudinal direction of the bulging portion 4 and the middle protruding portion 4*d* abuts on the inside flange portion 11, a transformation in the side wall direction of a middle position in the longitudinal direction of the inside flange portion 11 is prevented, and definite retention of the room 36 formed between the width narrow portion 4*b* and the inside flange portion 11 becomes easy.

In the above-described configuration, as the ninth aspect of the invention, also in the case where the convex portion 34 for a stopper is formed only on an inner periphery of a site matching with a middle portion in the longitudinal direction of the bulging portion 4 of the flat tube 7 in the external frame portion 10 of the frame body 13 and a middle portion in the longitudinal direction of the bulging portion 4 of the flat tube 7 is abutted on the convex portion 34, the same effect as that of claim 8 is exerted.

In the above-described configuration, as the tenth aspect of the invention, in the case where the outer periphery of the end portion of the casing 9 is expanded in a stepped shape to form the expansion end portion 35 and the expansion end portion 35 is fitted onto the outer periphery of the external frame portion 10 to keep the space between the inner face of the casing 9, excluding the expansion end portion 35, and the plate on the outermost side in the stacking direction of the stacked body 8 to the thickness of the external frame portion 10, it is possible to keep the gap between the casing 9 and the outermost plate constant and to perform a smooth circulation on a cooling water side.

In the above-described configuration, as the invention described in claim 11, in the case where respective components are integrally brazed in a high temperature furnace to form the heat exchanger, a heat exchanger that is easily assembled and achieves a high mass-productivity can be provided.

BRIEF DESCRIPTION OF THE DRAWINGS

FIG. 20(A) illustrates an exploded explanatory view of a conventional type heat exchanger core, and FIG. 20(B) illustrates a perspective view of the stacked body 8 thereof.

DETAILED DESCRIPTION OF THE INVENTION

Figure 1:
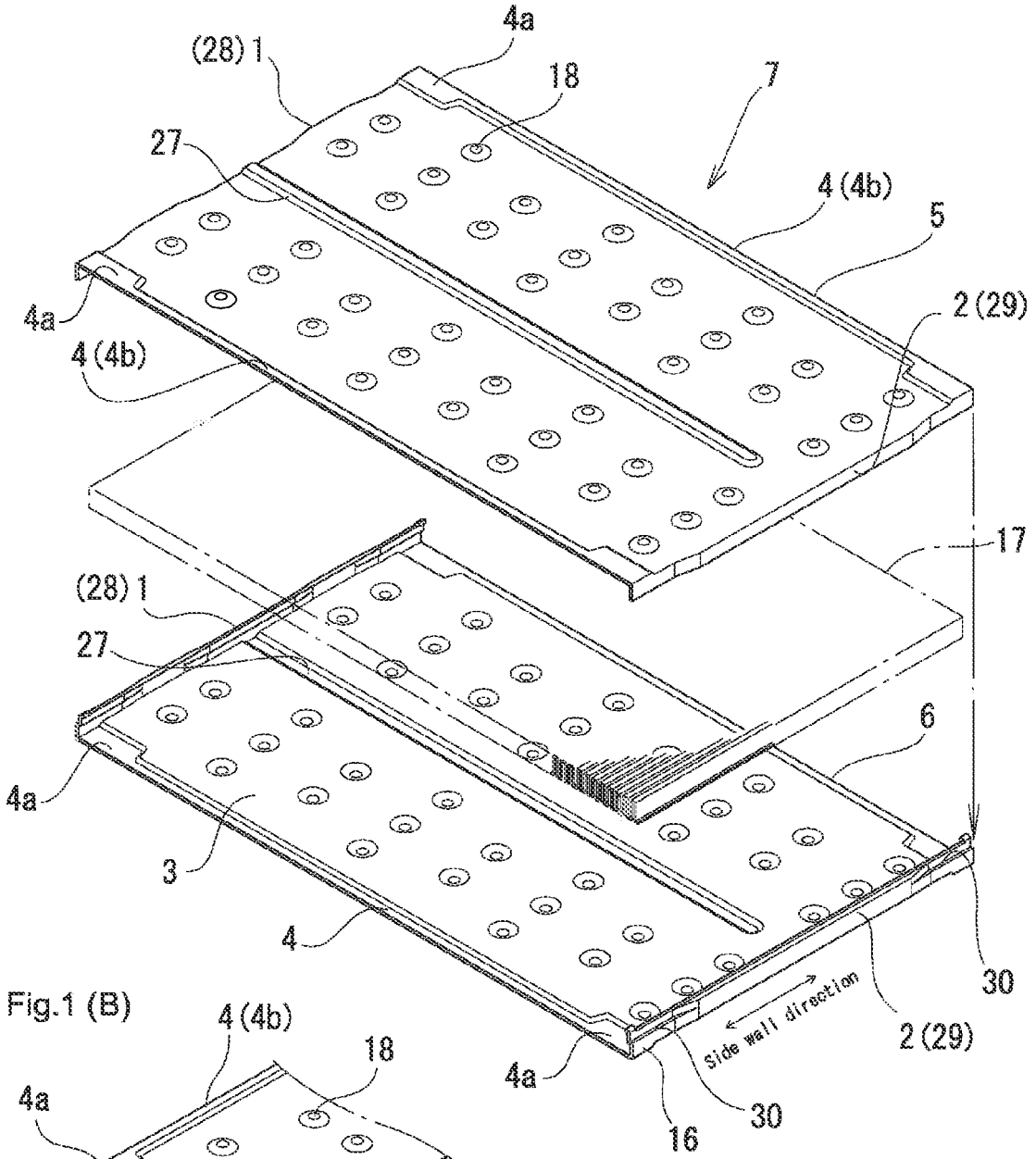
FIG. 1(A) illustrates an exploded perspective view of a flat tube 7 that is a constituent component of an assembly of a heat exchanger core of the present invention.
FIG. 1(B) illustrates an explanatory view showing an example of a case where a plate 5 and a plate 6 are fitted correctly.
Figure 1:
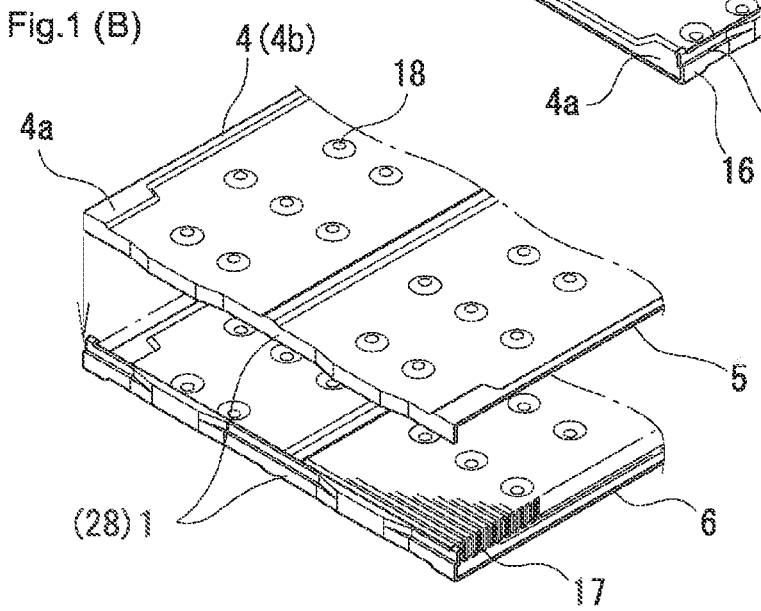

Next, referring to the drawings, embodiments of the present invention will be explained.

FIGS. 4-7 illustrate a temporarily assembled structure before brazing of a heat exchanger core of the present invention.

That is, by fitting a pair of the frame bodies 13 onto both ends of a stacked body 8 formed by stacking flat tubes 7, the stacked body 8 is restrained and held.

Note that, in the present invention, a direction in which a side wall land a side wall 2 of a pair of plates 5 and 6 extend (a direction of an axis connecting both openings of the flat tube 7) is defined as a side wall direction.

Figure 2:
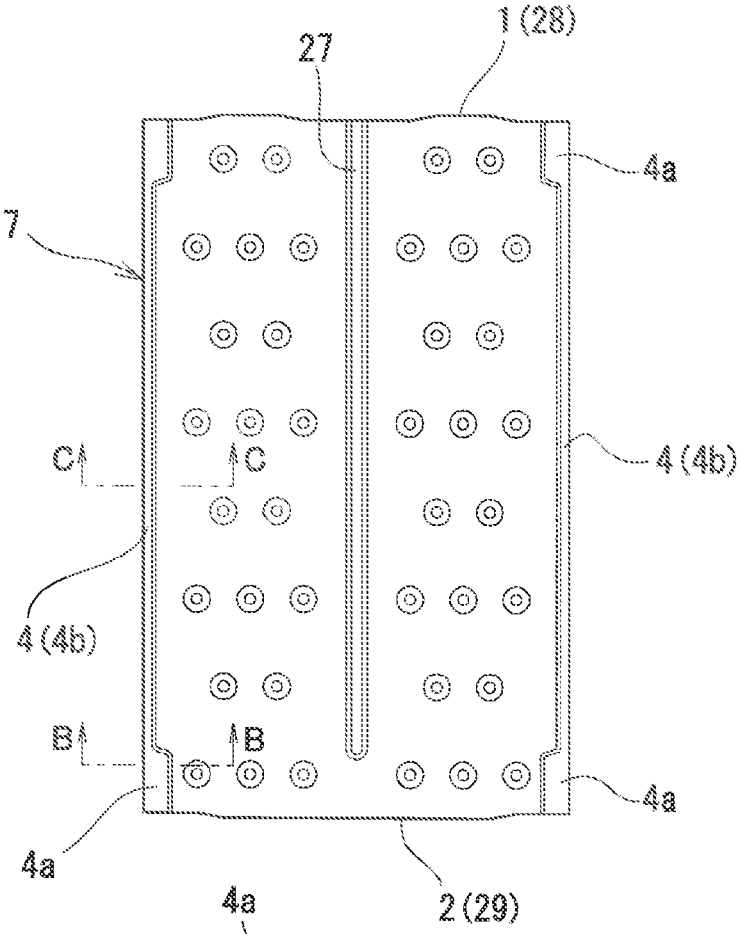
FIG. 2(A) illustrates a plan view of the same.
FIG. 2(B) illustrates a cross-sectional view of FIG. 2(A) seen along a B-B arrow.
FIG. 2(C) illustrates a cross-sectional view of FIG. 2(A) seen along a C-C arrow.
Figure 2:
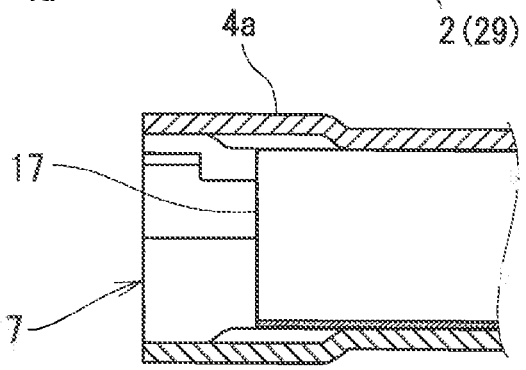
Figure 2:
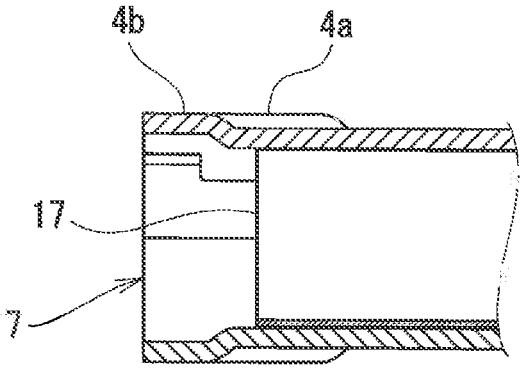
Figure 3:
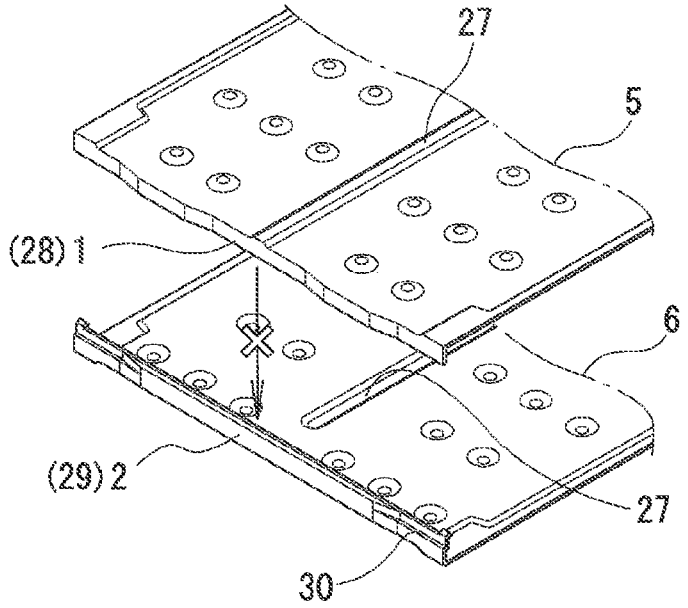
FIG. 3 illustrates respective side wall 1 and side wall 2 of the plate 5 and the plate 6, and an explanatory view that shows an example where the fitting thereof is mismatched.

The flat tube 7 constituting the stacked body 8 is composed, as shown in FIGS. 1-3, of a body in which a pair of the plate 5 and plate 6 are superimposed in a reverse direction each other.

In each of the plate 5 and plate 6, on both ends thereof, the side wall 1 and the side wall 2 are extended upward orthogonally to a groove bottom 3. Then, on the groove bottom 3 of both opening edges of the flat tube 7, bulging portions 4 bulging in a thickness direction of the flat tube 7 are formed.

Moreover, the bulging portion 4 is composed of width wide portions 4*a* lying at both end portions in the longitudinal direction thereof with a wide width in the side wall direction, and a width narrow portion 4*b* with a narrow width that lies between these width wide portions 4*a* and is formed at an opening edge of the flat tube 7. Between these pair of plate 5 and plate 6, an inner fin 17 is interposed.

For the plate 6 on one side, a width shrinking part 16 shrunk at both ends in the side wall direction of a pair of the side walls 1 and 2 is formed, and, there, a step part 30 is formed in a stepped shape on an inner side by the magnitude of thickness. On the step part 30, edge parts of a pair of the side wall 1 and side wall 2 of the plate 5 on the other side are seated.

In the example, on the outer face side of each of the plate 5 and plate 6, a partition portion 27 is provided, protruding in the bulge direction of the bulging portion 4 of the flat tube 7. One end of the partition portion 27 abuts on a joint with the bottom portion 3 of one side wall 1, and the other end is formed, without reaching the other side wall 2, up to nearby the same. Moreover, for each of the plates 5 and 6, a number of dimples 18 are formed, protruding in the bulge direction of the bulging portion 4. Heights of the partition portion 27 and dimple 18 are the same as the height of the bulging portion 4.

In addition, shapes of the side wall 1 and the side wall 2 of respective plates 5 and 6 are different from each other.

The side wall 1 on one side protrudes in an "M-like" shape slightly outward in a flat face to forma first fitting structure 28, and the side wall 2 on the other side protrudes in a "mountain-like" shape slightly outward in a flat face to form a second fitting structure 29. In other ward, it is so configured that the combination of both first fitting structures 28 of the plate 5 and plate 6 allows these to be fitted with each other. As the result of making the figure of the side wall 1 on one side different from the figure of the side wall 2 on the other side, when the side wall 1 and side wall 2 of the pair of plates 5 and 6 are combined, a mismatch thereof can be prevented.

FIG. 3 illustrates a case where they are mismatched. In this case, the first fitting structure 28 of the side wall 1 on one side of the plate 5 and the second fitting structure 29 of the side wall 2 of the plate 6 have different structures and cannot be combined.

Figure 12:
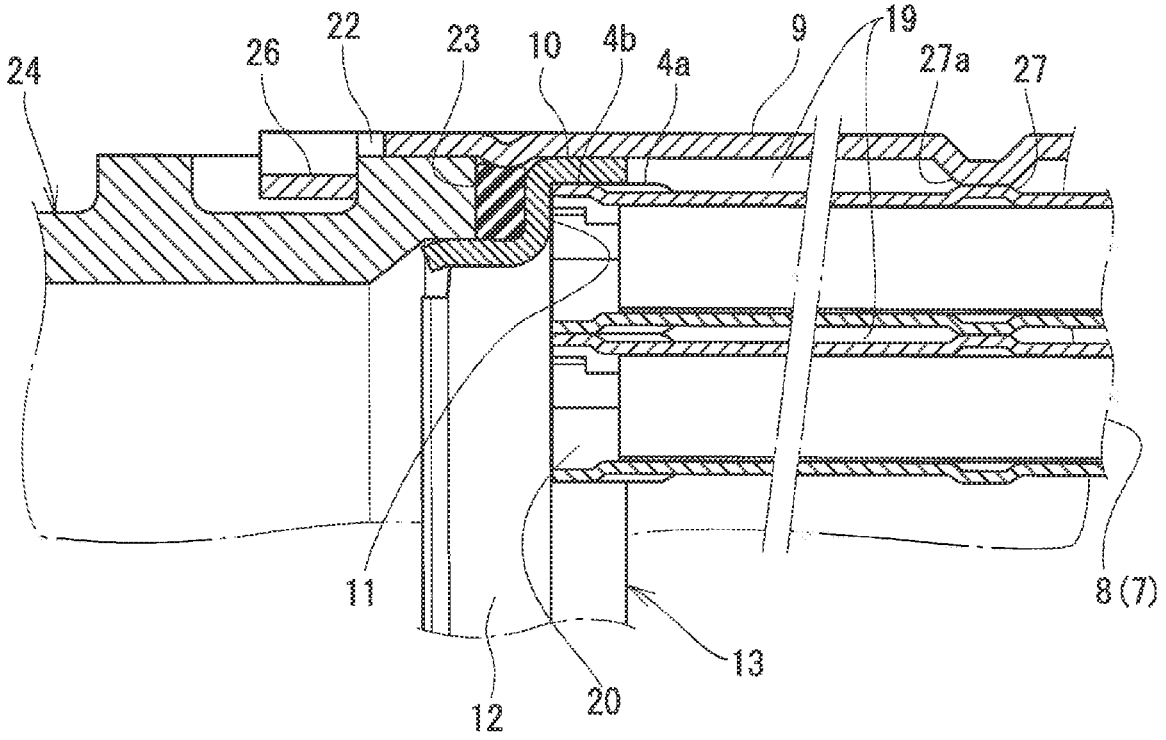
FIG. 12 illustrates a main part longitudinal cross-sectional view showing the relationship among the stacked body 8, the casing 9 fitted onto the outer periphery thereof, the tank 24, and the packing 23.

By preventing a mismatch in this way, the partition portion 27 of each of plates 5 and 6 can be set, shifted to the side wall 1 on one side, and, as shown in FIG. 12, a first circulation path 19 is formed in a room surrounded by the outer face side of the flat tube 7 and the inner face of the casing 9 to enable a first fluid 32 (for example, cooling water) to be supplied in a U-like shape.

Figure 11:
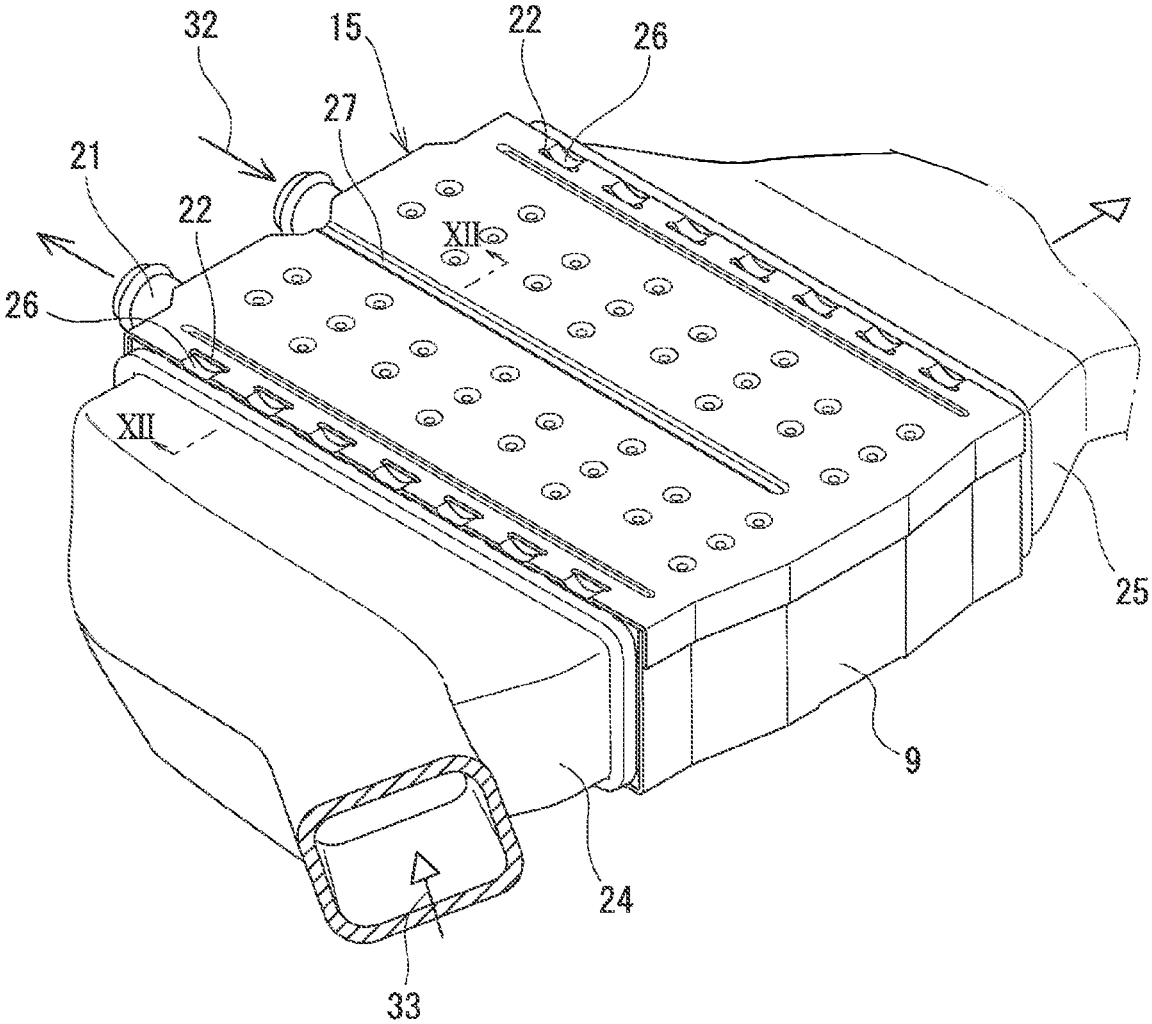
FIG. 11 illustrates an explanatory view showing the state where a pair of the tank 24 and tank 25 are attached to the both ends of the heat exchanger core 15.

Incidentally, in the inside of the flat tube 7 as shown in FIG. 12, a second circulation path 20 is formed, and, as shown in FIG. 11, a second fluid 33 (for example, exhaust) is circulated. The inner fin 17 interposed in the inside of the flat tube 7 is arranged, as shown in FIG. 2(C), so that the tip thereof is close to the opening of the flat tube 7 (the width narrow portion 4*b*).

Figure 4:
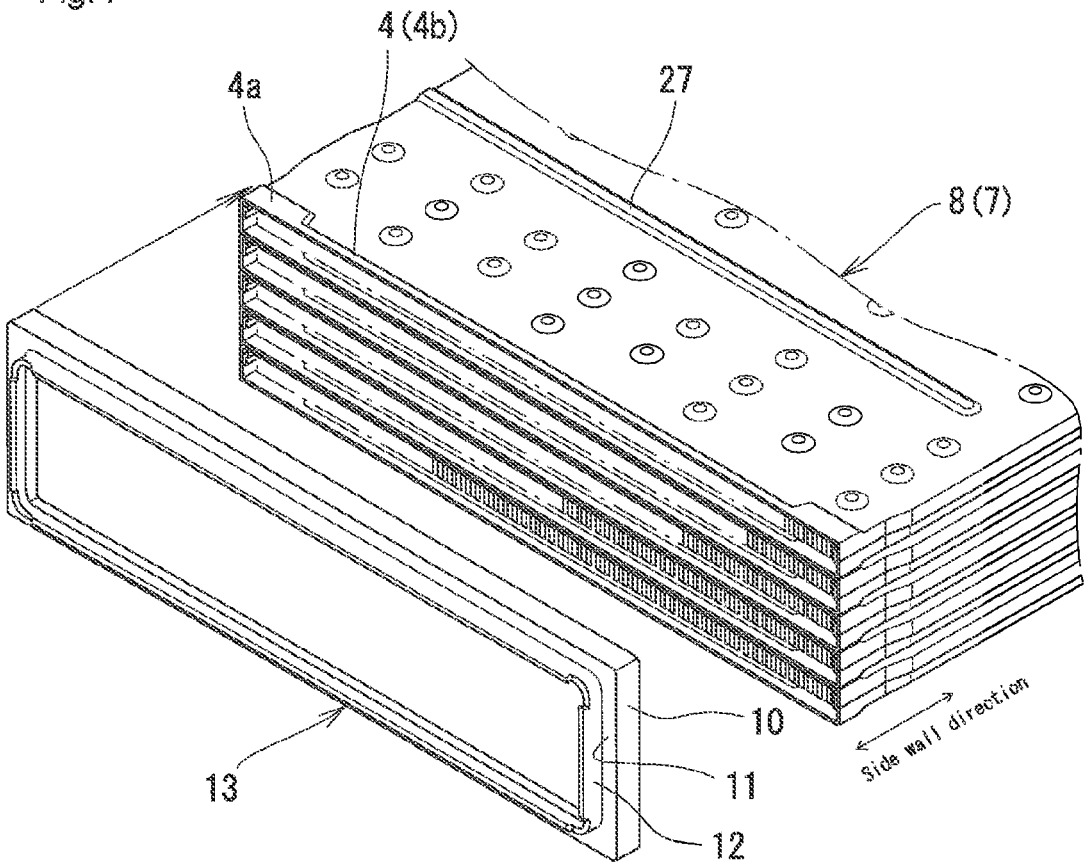
FIG. 4 illustrates a perspective view of a stacked body 8 including an assembly of flat tubes 7, and a perspective view of a frame body 13 to be fitted onto the outer periphery of the stacked body 8.
Figure 6:
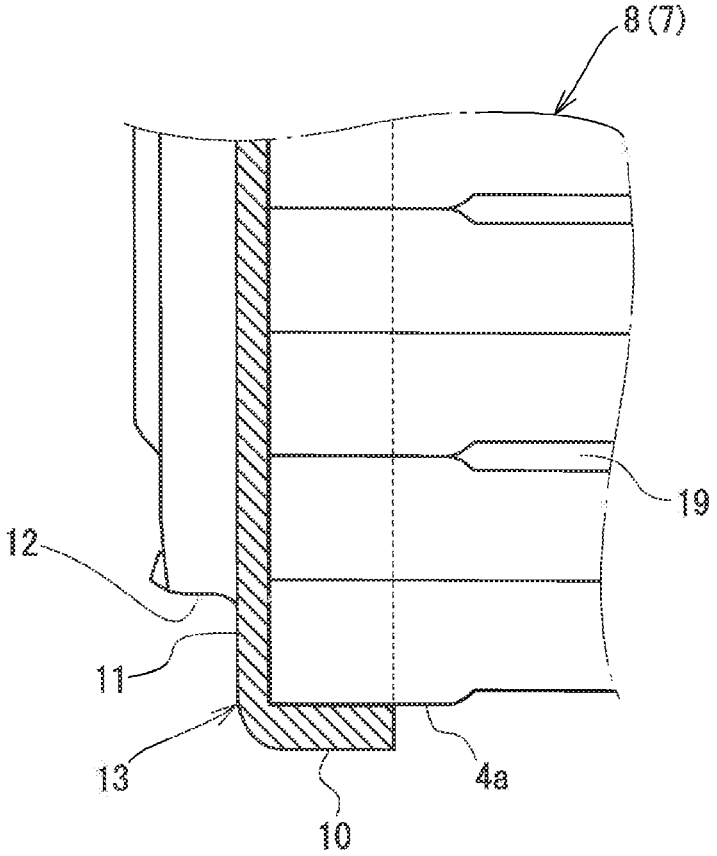
FIG. 6 illustrates an explanatory view showing the relationship between the frame body 13 and the stacked body 8 on a side face of the stacked body 8.

The bulging portion 4 of the flat tube 7 has the width narrow portion 4*b* with a narrow width and the width wide portion 4*a* with a comparatively wide width arranged at both ends thereof. The width wide portion 4*a* is formed at four corners of respective plates 5 and 6. Each width wide portion 4*a* and each width narrow portion 4*b* are formed, in a case where the flat tubes 7 are stacked as shown in FIG. 4 and FIG. 6, so that they are matched with each other. Moreover, the flat tubes 7 configure the stacked body 8 in a state where side walls 1 having the first fitting structure 28 are adjusted each other.

Next, as shown in FIG. 4, the frame body 13 has an external frame portion 10 whose inner periphery matches with the outer periphery of the stacked body 8, an inside flange portion 11 bent inward from the edge part of the external frame portion 10, and a packing holding portion 12 extended upward, outward from an inner peripheral edge of the inside flange portion 11 and extends in the side wall direction.

Figure 5:
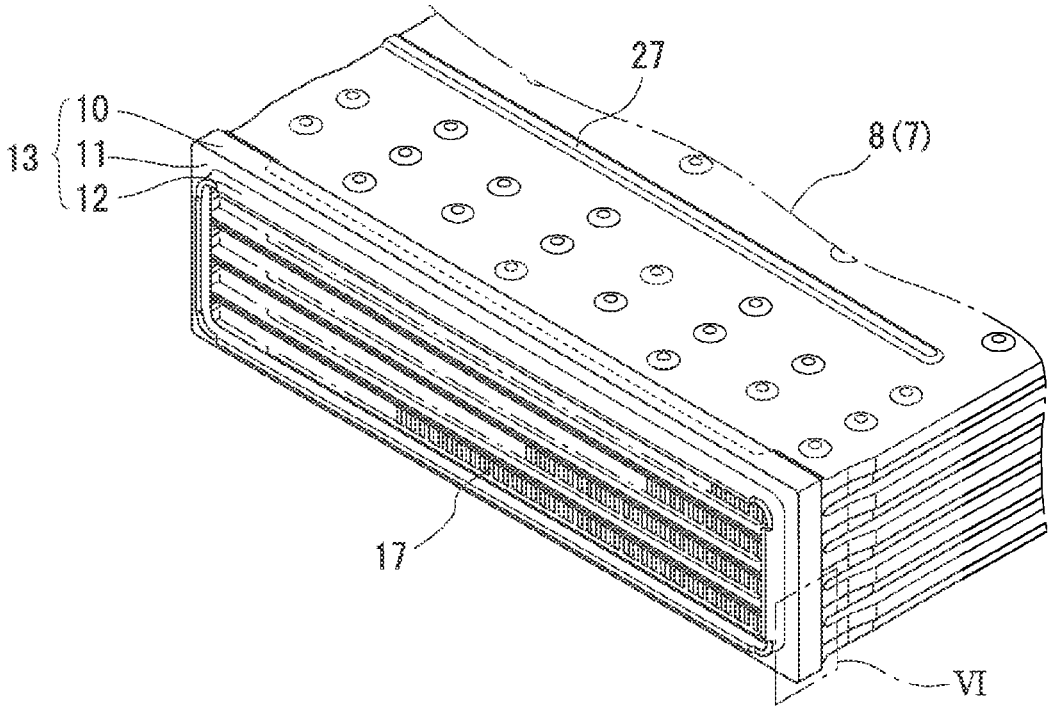
FIG. 5 illustrates a main part perspective view showing a state where the frame body 13 is fitted onto the stacked body 8.

Further, as shown in FIG. 4 and FIG. 5, the external frame portion 10 of the frame body 13 is fitted onto the outer periphery of the bulging portion 4 of the stacked body 8, and the opening end of the stacked body 8 abuts on the inside flange portion 11 of the frame body 13. Thereby, both ends of the stacked body 8 including the large number of flat tubes 7 are restrained.

At this time, as shown in FIG. 6, the external frame portion 10 of the frame body 13 is fitted onto the width wide portion 4*a* of the bulging portion 4 of the stacked body 8 to improve the reliability of brazing, in particular, at the corner portion of the stacked body 8. Moreover, the contact part of the width wide portion 4*a* gives a large contact area thereof to improve the strength of the brazing between the flat tubes 7. In other words, in FIG. 4, the external frame portion 10 of the frame body 13 surely holds the width wide portion 4*a* at the corner portion of the stacked body 8, and the brazing between the width wide portion 4*a* and the frame body 13 is performed surely. At this time, as shown in FIG. 6, the contact length between the width wide portions 4*a* is set, preferably, to be slightly longer than the length of the external frame portion 10.

Figure 7:
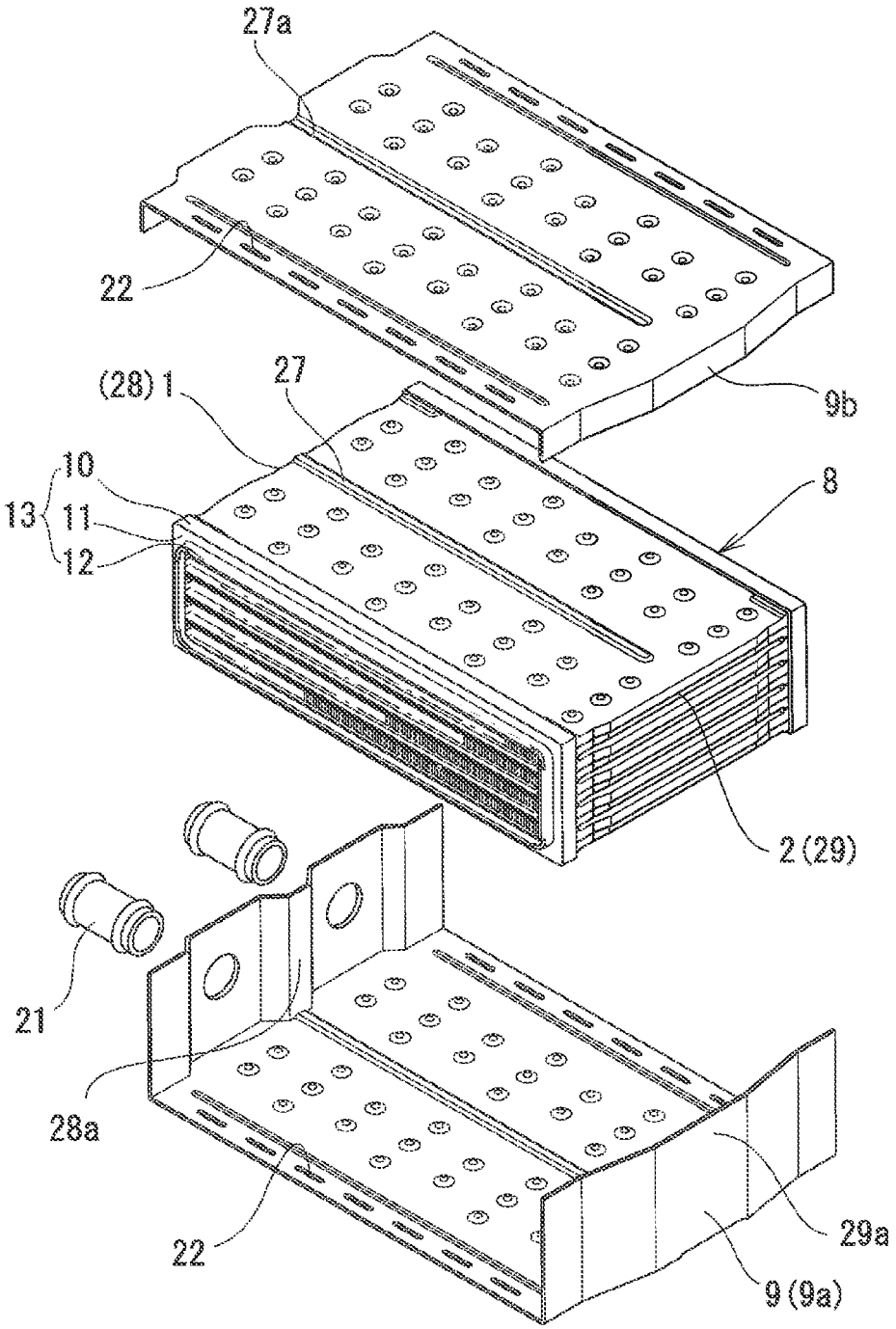
FIG. 7 illustrates an exploded perspective view of the stacked body 8 restrained by a pair of the frame bodies 13, and the casing 9.

The stacked body 8 whose both ends have been restrained by a pair of the frame bodies 13 is housed, as shown in FIG. 7, in the casing 9. The casing 9 includes a main body 9*a* that has a U-like-shaped longitudinal cross-section with a pair of a first side wall 28*a* and a second side wall 29*a* extended upward, and an end lid 9*b* fitted onto the opening end of the main body 9*a*. Moreover, into the main body 9*a* a pair of pipes 21 are fitted.

The first side wall 28*a* of the main body 9*a* is formed in an "M-like" shape, and, to the apex of the "M-like" shape, the pipe 21 is attached. The second side wall 29*a* is formed in a "mountain-like" shape. Preferably, for the second side wall 29*a* in a "mountain-like" shape, a convex portion for positioning the stacked body 8 may be provided toward the inner side of the main body 9*a*. The end lid 9*b* is formed so as to match with the external shape of the main body 9*a*. Moreover, for the main body 9*a* and the end lid 9*b*, a partition portion 27*a* matching with the position of the partition portion 27 of the stacked body 8 is provided in a recessed state on the internal side of the casing 9.

Figure 8:
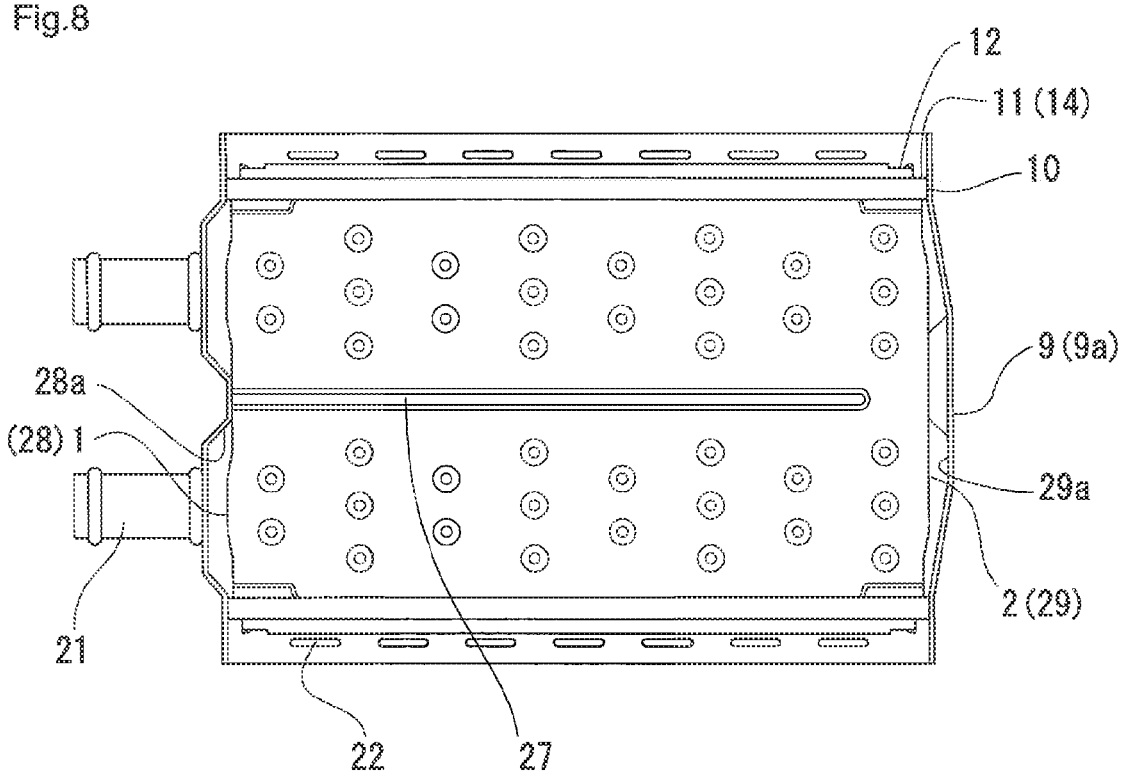
FIG. 8 illustrates a plan view showing a state where the stacked body 8 restrained by a pair of the frame bodies 13 is attached to a main body 9*a* of the casing 9.

FIG. 8 illustrates a fitted state between the stacked body 8 and the main body 9*a* of the casing 9.

As mentioned above, the stacked body 8 is stacked in the state where the side wall 1 sides having the first fitting structure 28 of the flat tube 7 have been adjusted, and, therefore, one side of the side wall 1 has an "M-like" shape and the other side of the side wall 2 has a "mountain-like" shape.

Due to the difference in the shapes, in a case where the stacked body 8 is attached to the main body 9*a* of the casing 9, wrong place insertion is prevented.

That is, on the second side wall 29*a* side of the main body 9*a*, the second fitting structure 29 side of the stacked body 8 is arranged, and, on the first side wall 28*a* side of the main body 9*a*, the first fitting structure 28 side of the stacked body 8 is arranged. As illustrated in the drawing, a valley part of the first side wall 28*a* of the main body 9*a* abuts on a base position where the partition portion 27 of the stacked body 8 is formed, and the second side wall 29*a* of the main body 9*a* abuts on the second fitting structure 29 side of the stacked body 8. Thereby, the stacked body 8 is temporarily assembled for the main body 9*a*.

Figure 9:
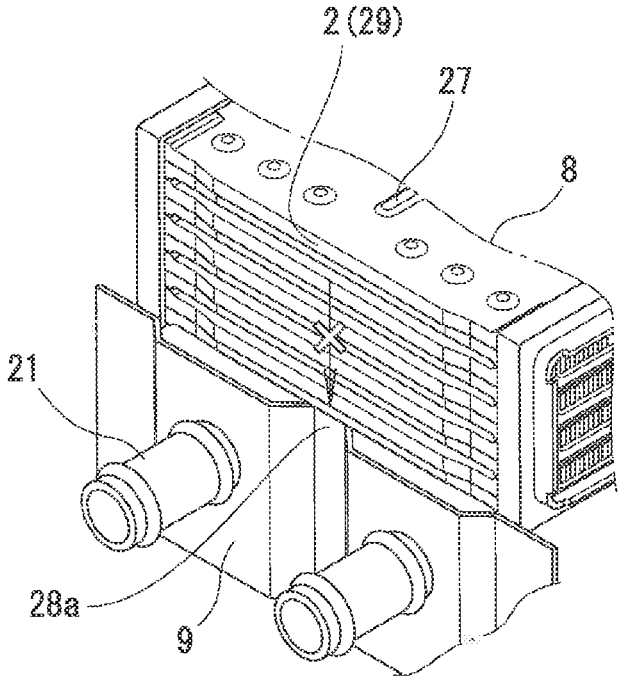
FIG. 9 illustrates an explanatory view showing an example of a mistake in attaching, upon assembling the casing 9 and the stacked body 8.

Inversely, as shown in FIG. 9, in a case where the second fitting structure 29 side of the stacked body 8 is erroneously going to be arranged to the first side wall 28*a* of the main body 9*a*, due to the valley portion of the M-like shape of the main body 9*a*, the second fitting structure 29 side of the stacked body 8 is caught on to prevent wrong place insertion.

In the state the end lid 9*b* is fitted on, and a heat exchanger core 15 is assembled, which is inserted into a high temperature furnace to braze integrally respective components.

Incidentally, at least one side of respective components to be brazed each other is covered or applied with a brazing material.

Figure 10:
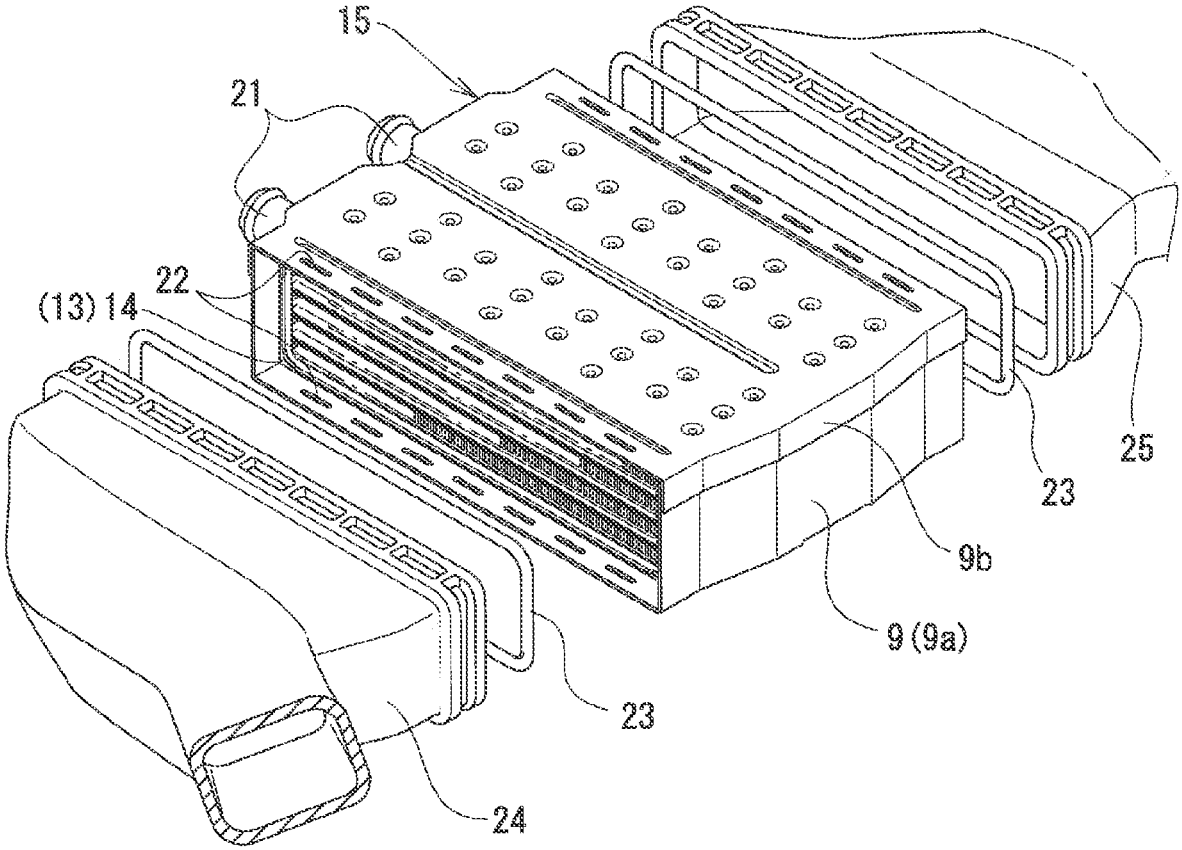
FIG. 10 illustrates an explanatory view showing the relationship between the heat exchanger core 15 and a pair of the tank 24 and tank 25.

After the brazing, as shown in FIG. 8, FIG. 10, in a portion to which a tank of the heat exchanger core 15 is attached, an annular groove 14 into which a packing for seal can be inserted is formed among a packing grasping portion 12 of the frame body 13, the inside flange portion 11, and inner walls of both end edges of the casing 9. Then, a packing 23 is arranged to the annular groove 14, and, subsequently, a pair of a tank 24 and tank 25 are fitted.

Then, as shown in FIG. 11, FIG. 12, an outside of each slit 22 provided for both opening ends of the heat exchanger core 15 is caulked to fix the casing 9 and the tank 24, and the casing 9 and the tank 25 by a caulk part 26. In the example, the tank 24 and the tank 25 are composed of AL cast.

Figure 13:
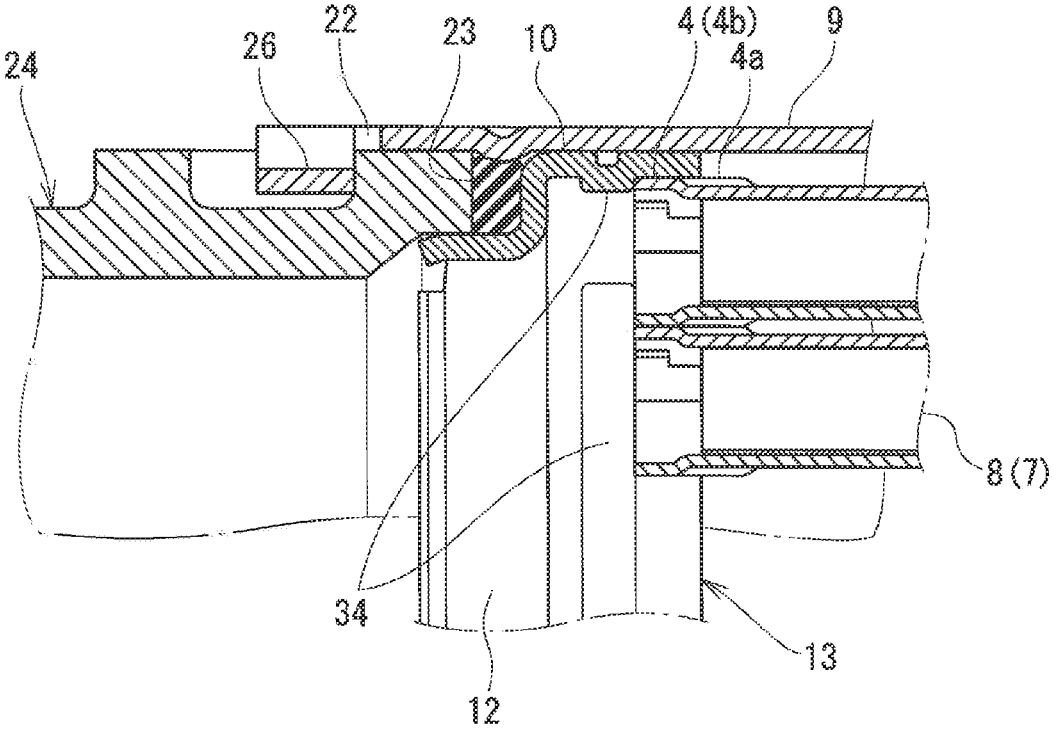
FIG. 13 illustrates a modified example of the frame body 13 for use in the present invention, in which (A) is a main part longitudinal cross-sectional view thereof, and (B) is a perspective view of the frame body 13.
Figure 13:
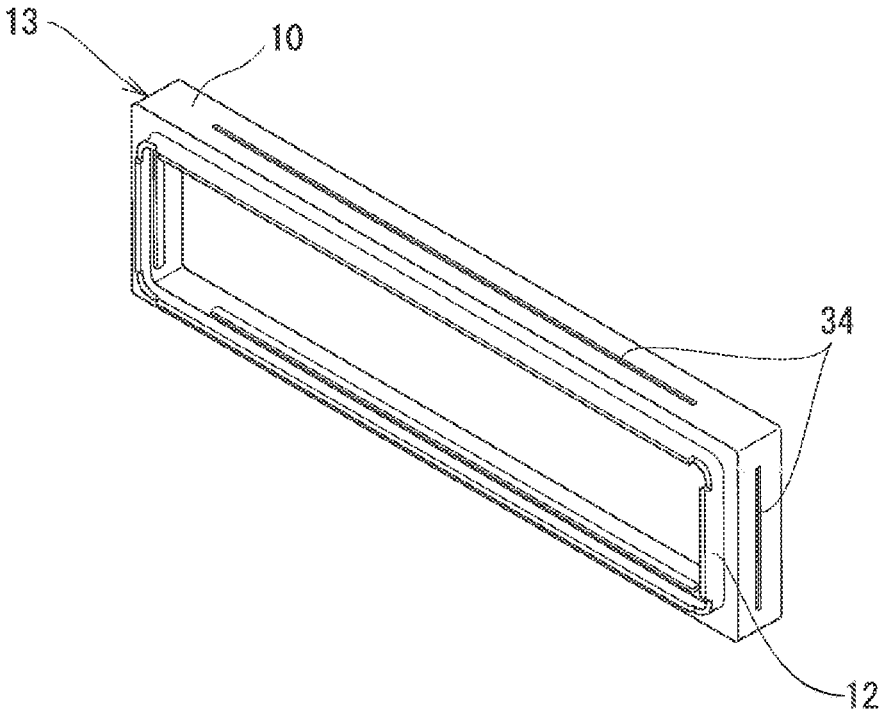

Next, FIG. 13 shows a modified example of the frame body 13 for use in the present invention, in which (A) is a main part longitudinal cross-sectional view, and (B) illustrates a perspective view of the frame body 13.

Different points of this example from Example in FIG. 12 are that the length of the external frame portion 10 of the frame body 13 is prolonged in the side wall direction, and, in a middle part in the prolonged direction, the convex portion 34 for a stopper is formed along the inner periphery of the external frame portion 10, and the end edge of each flat tube 7 is abutted thereon to perform positioning.

As the result of prolonging the external frame portion 10 in this way, the inner volume of the external frame portion 10 is expanded to smoothly circulate a fluid from the tank 25 to each stacked body 8.

Figure 14:
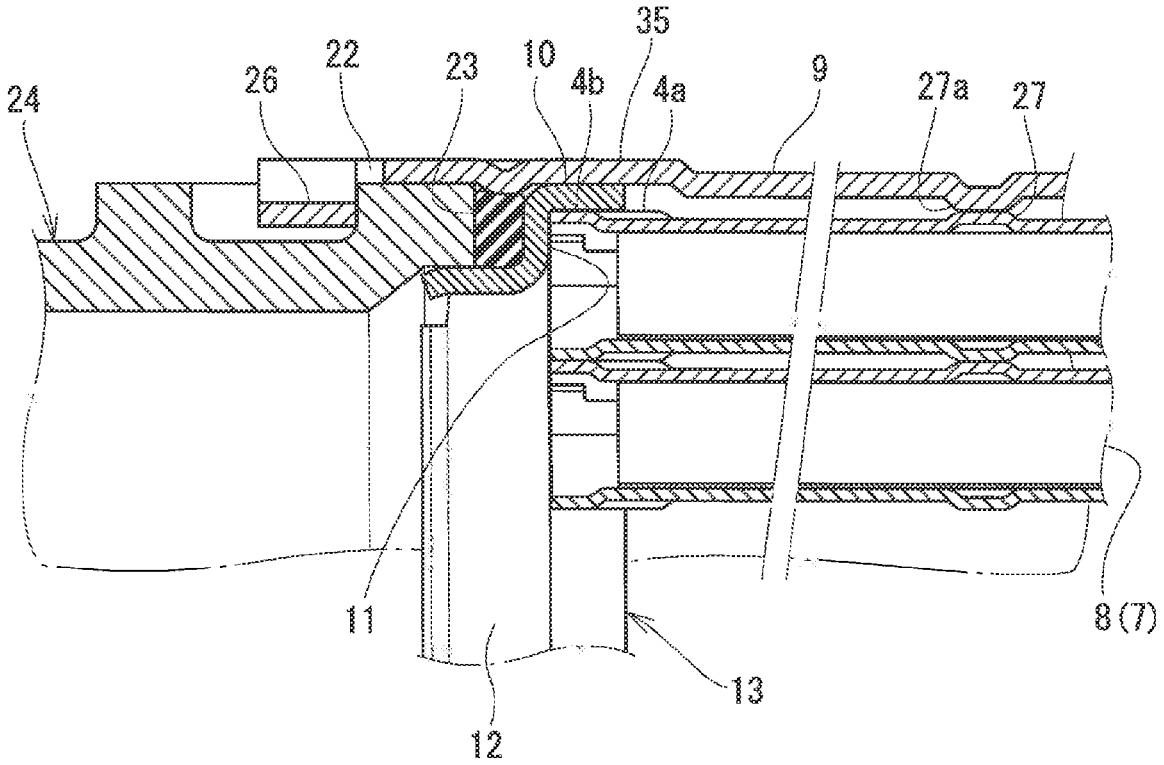
FIG. 14 illustrates a main part longitudinal cross-sectional view showing a modified example of the casing 9 for use in the present invention.

Next, FIG. 14 illustrates a longitudinal cross-sectional view of a modified example of the casing 9 for use in the present invention. A different point of this example from one illustrated in FIG. 12 is that the end portion of the casing 9 is expanded in a stepped shape and an expansion end portion 35 is formed there. Then, the expansion end portion 35 is fitted onto the outer periphery of the external frame portion 10.

Thereby, the space between the external frame portion 10 and the plate of the flat tube 7 on the outermost side is set to be equal to the thickness of the external frame portion 10. Then, the partition portion 27*a* of the casing 9 and the partition portion 27 of the plate of the flat tube 7 on the outermost side are closely attached to each other, to cause a fluid circulating around the partition to circulate smoothly in a U-like shape.

Figure 15:
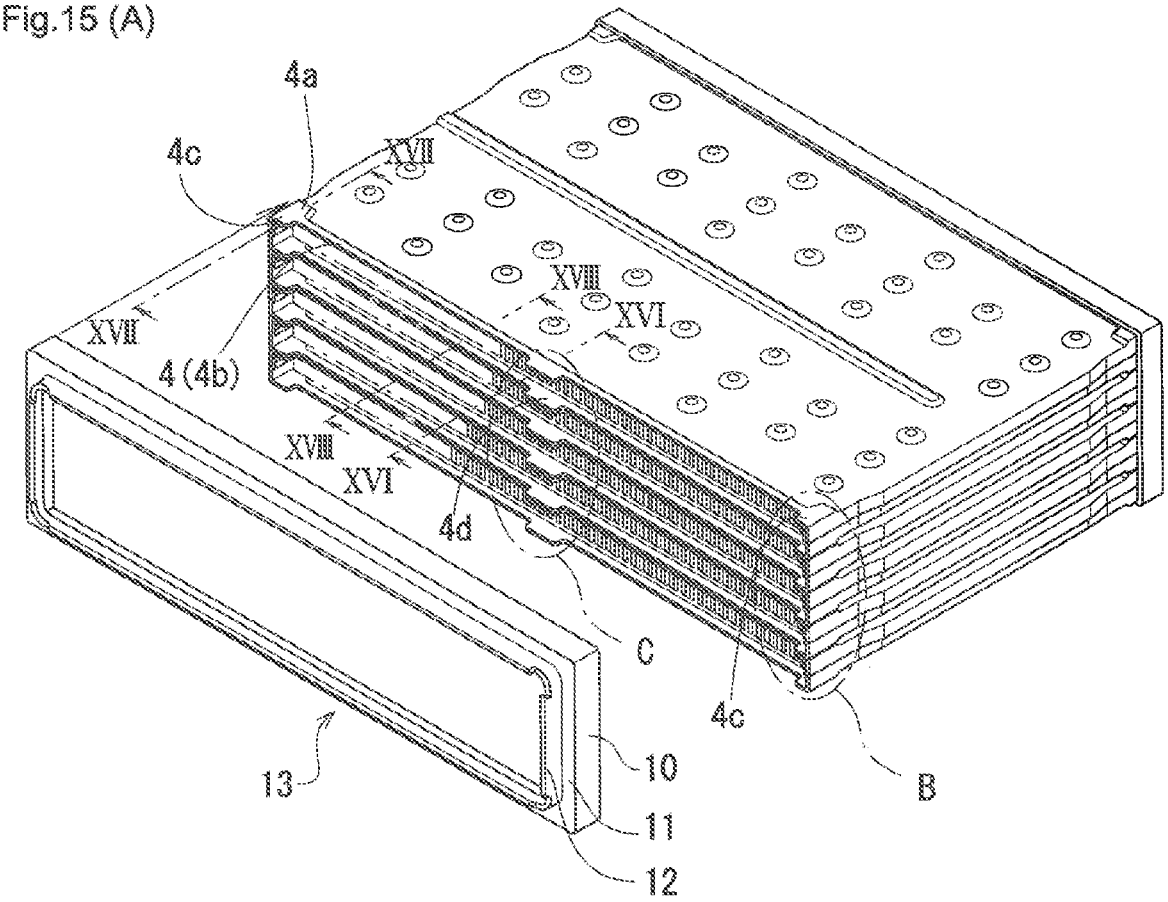
FIG. 15(A) illustrates a perspective view showing a modified example of the flat tube 7 (the stacked body 8) for use in the present invention.
FIG. 15(B) illustrates a B part enlarged view.
FIG. 15(C) illustrates a C part enlarged view.
Figure 15:
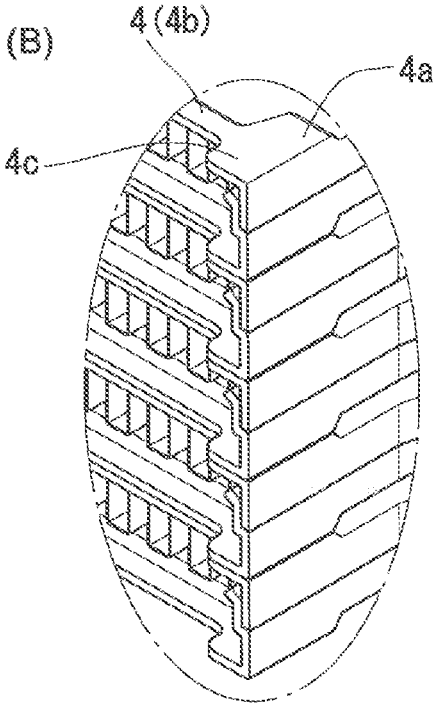
Figure 15:
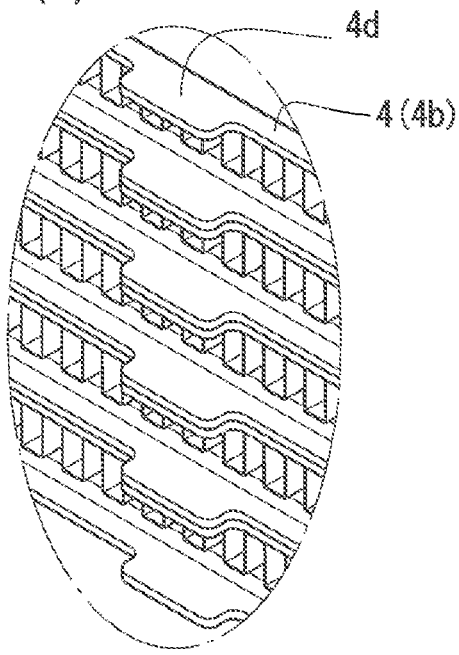

Next, FIG. 15 illustrates a modified example of the flat tube 7 for use in the present invention, and the stacked body 8 is configured using the flat tube 7.

In this flat tube 7, as shown in FIG. 15, an end tongue piece portion 4*c* protrudes from the tip of the width wide portion 4*a* of each of the plates 5 and 6 toward the side wall direction. In FIG. 15, as shown in FIG. 15(B), the end tongue piece portion 4*c* is provided in a protruding state in approximately L-like shape in a state of including a part of each of the side walls 1 and 2. Further, preferably a middle protruding portion 4*d* is protruded in the side wall direction at a middle position in the longitudinal direction of the width narrow portion 4*b*. The length of each end tongue piece portion 4*c* and the protruding length of the middle protruding portion 4*d* are set to be approximately identical.

Figure 16:
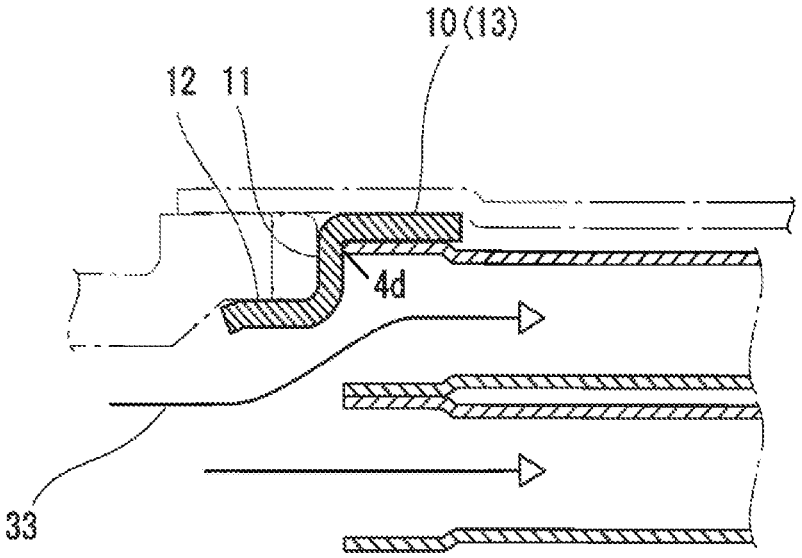
FIG. 16 illustrates a cross-sectional view seen along an arrow XVI-XVI in FIG. 15.
Figure 17:
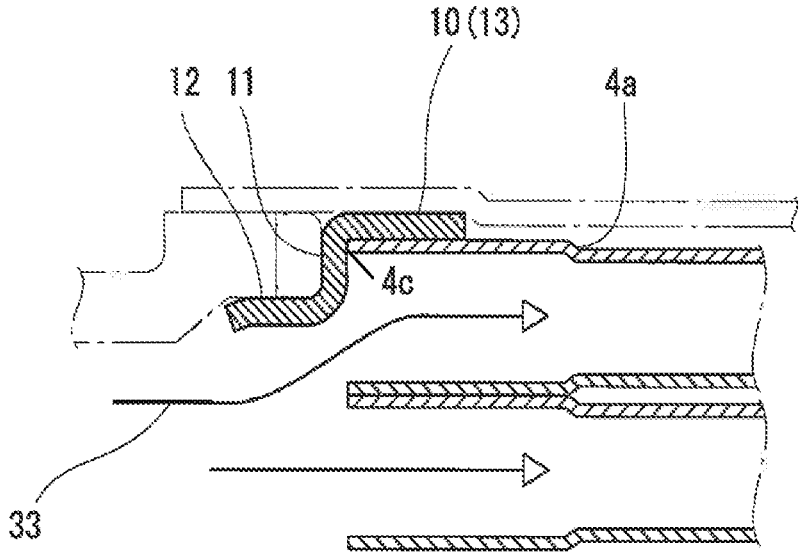
FIG. 17 illustrates a cross-sectional view seen along an arrow XVII-XVII in FIG. 15.
Figure 18:
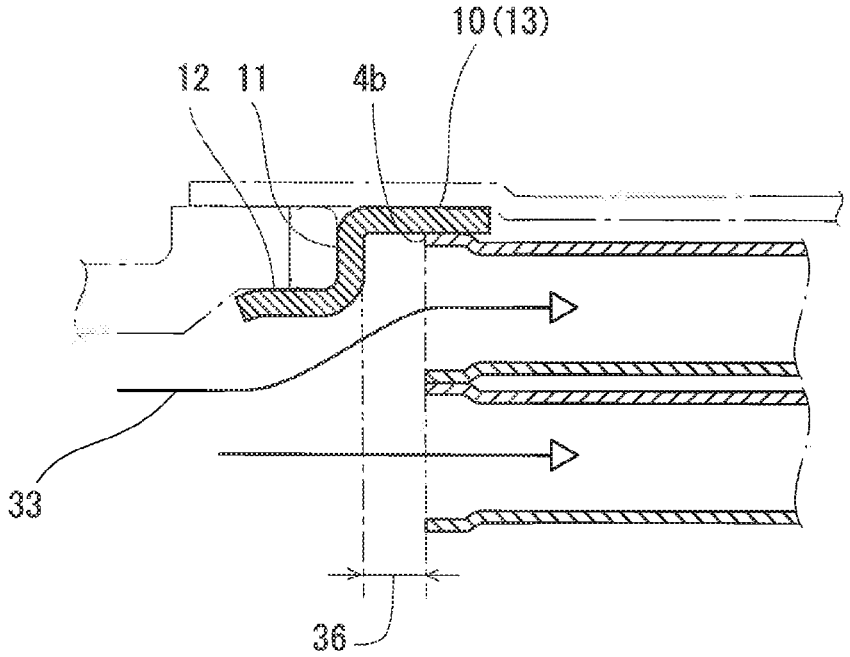
FIG. 18 illustrates a cross-sectional view seen along an arrow XVIII-XVIII in FIG. 15.

As shown in FIG. 16, FIG. 17, the tip of each end tongue piece portion 4*c* and the tip of the middle protruding portion 4*d* on the outer periphery of the stacked body 8 abut on the inside flange portion 11 of the frame body 13 to form, as shown in FIG. 18, a room 36 between the width narrow portion 4*b* and the joint of the frame body 13. Thereby, a fluid is allowed to be led smoothly to the opening of each flat tube 7.

In addition, in the case where the flat tube 7 of the Example is to be used, as shown in FIG. 18, it is necessary to prolong the width of the external frame portion 10 of the frame body 13 to be fitted onto the stacked body 8 at least to such a degree that the width narrow portion 4*b* of the bulging portion 4 of the stacked body 8 is to be fitted.

Figure 19:
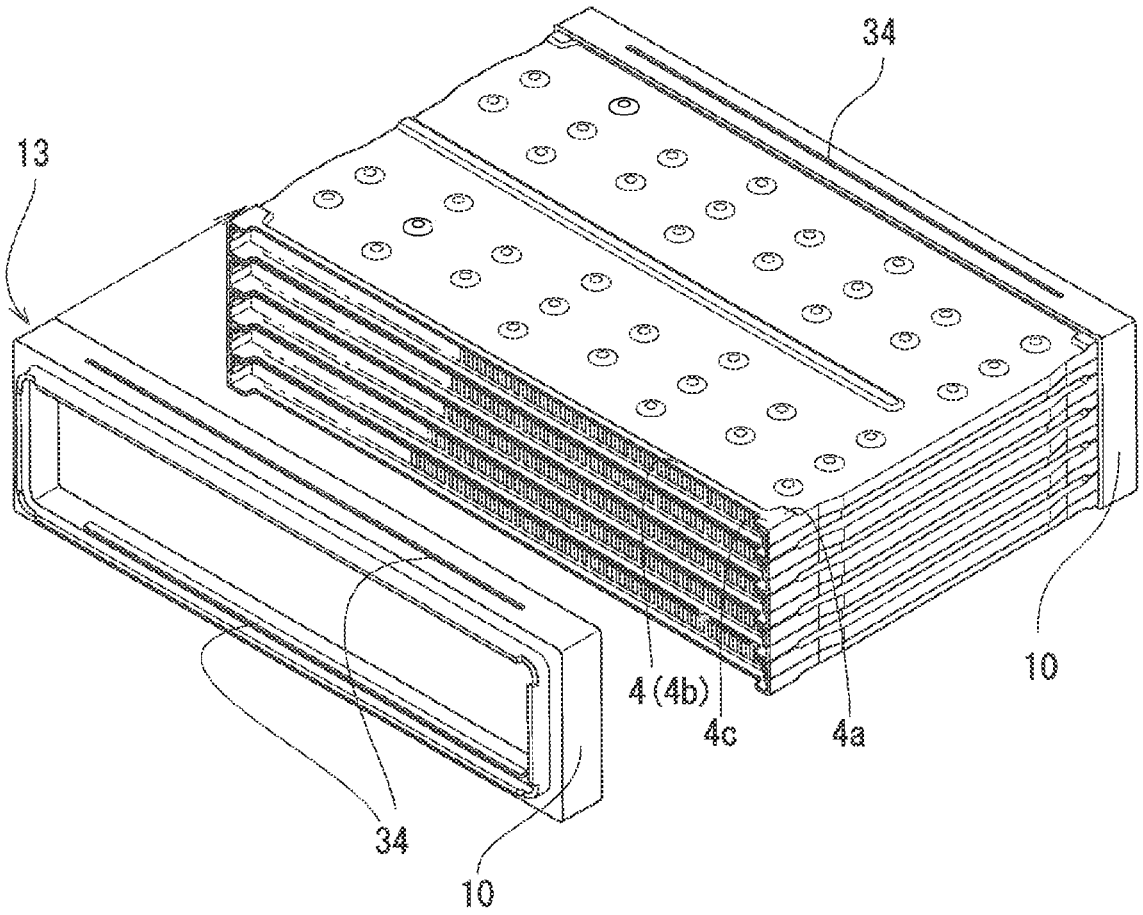
FIG. 19 illustrates a perspective view showing a modified example of the flat tube 7 (the stacked body 8) and the frame body 13 for use in the present invention.
Figure 21:
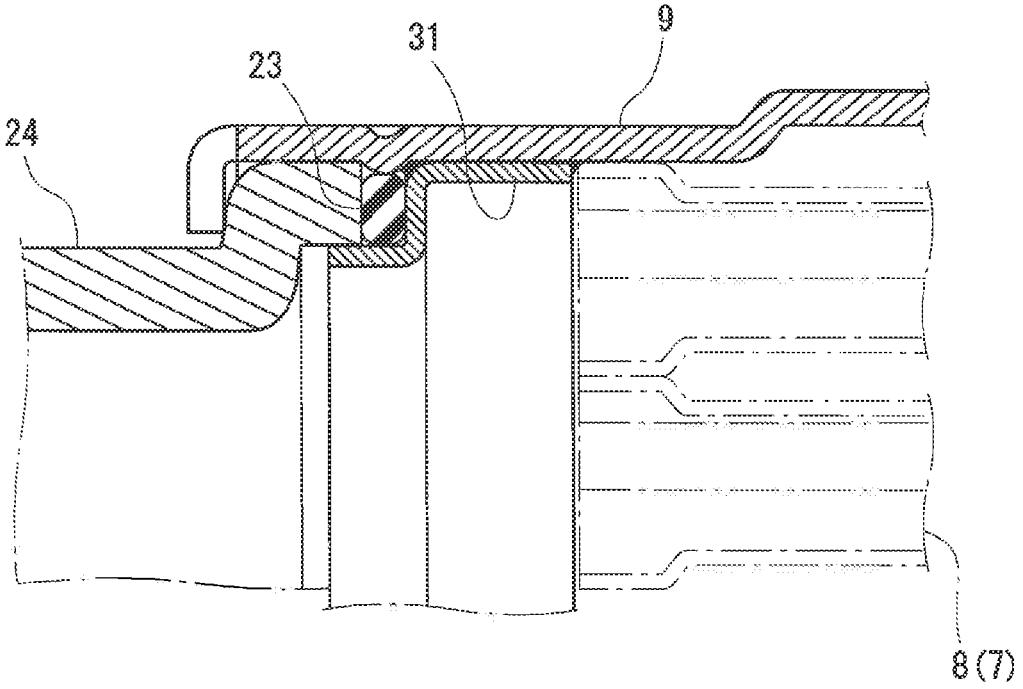
Fig.21 PRIOR ART
FIG. 21 illustrates a main part longitudinal section of the conventional type heat exchanger core.

Incidentally, as shown in FIG. 19, an embodiment, in which the end tongue piece portion 4*c* alone is provided for the flat tube 7 and, for the external frame portion 10 of the frame body 13, the convex portion 34 for a stopper is provided only on an inner periphery of the matching site with the middle portion in the longitudinal direction of the bulging portion 4 of the flat tube 7, is adoptable.

The shape of the first fitting structure 28 and the shape of the second fitting structure 29 may be different from that in the above-described Example. Moreover, the shape of the casing 9 can also be changed in accordance with these shapes. For example, in a case where a number of partition portions 27 of a heat exchanger are provided to set a flow path length of the first circulation path to be longer, the shape of the side wall of the flat tube 7 is changed and, in accordance with the shape, the shape of the casing 9 is also changed.

A material quality of the tank is not limited and, for example, a tank may be an injection molded article of resin.

The dimple 18 provided on the outer surface of the flat tube 7 in this Example may be omitted.

In a caulked structure of a tank and a heat exchanger core may be a structure performed by providing a number of caulking claws for an opening end of a heat exchanger core and bending these toward the tank side, in place of a structure performed by the slit 22.

The invention claimed is:

1. A heat exchanger core without a header plate, comprising:

a plurality of like flat tubes, wherein each of the flat tubes is comprised of a pair of like rectangular plates, each of the plates having an upper face, the upper face being predominantly planar and configured for flow of a fluid, each of the plates having a pair of side walls only at each of a first pair of mutually opposed edges of the upper face, the side walls extending along the first pair of edges, orthogonally to a plane of the upper face, each of the plates having bulging parts contiguous with each of a second pair of mutually opposed edges of the upper face, a direction of bulging of the bulging parts being opposite a direction in which the side walls extend along the first pair of edges, the pair of rectangular plates being joined together at longitudinal edges of the side walls to form a respective one of the flat tubes in which the side walls of the plates constitute side walls of the flat tube;

wherein the bulging parts at each of the second pair of edges comprise:

respective portions at ends of the edge of the second pair which are wider in a direction parallel to the side walls; and a portion between and contiguous with the wider portions and which is narrower in the direction parallel the side walls;

wherein the plurality of flat tubes is arranged as a stack of the plates with the first pairs and second pairs of mutually opposed edges of the plates in alignment;

a casing in which the stack of flat tubes is arranged, wherein the casing is comprised of casing side walls overlying the side walls of the flat tubes and casing upper and lower walls overlying, respectively, an upper wall of the uppermost flat tube and a lower wall of the lowermost flat tube in the stack;

a pair of like frames each received over an outer periphery of a respective edge portion of the stack comprised of exposed edges of the bulging parts, wherein each of the frames comprises:

a peripheral flange portion having an inner periphery configured to match and be received over the outer periphery of said respective edge portion of the stack; and a peripheral packing holding portion formed at an inner edge of the flange portion and extending away from the flange portion orthogonally to said respective edge portion of the stack; and wherein, at each of open ends of the casing an annular groove configured to hold a packing to provide a seal is formed between the packing holding portion of the frame and edges of the casing at the open end of the casing.

2. The heat exchanger core without a header plate according to claim 1, wherein:

width of the portions which are wider in a direction parallel to the sidewalls is greater than interior depth of the frame flange portion in a direction parallel to the side walls.

3. A heat exchanger core without a header plate comprising:

a plurality of like flat tubes, wherein each of the flat tubes is comprised of a pair of like rectangular plates, each of the plates having an upper face, the upper face being predominantly planar and configured for flow of a fluid, each of the plates having a pair of side walls only at each of a first pair of mutually opposed edges of the upper face, the side walls extending along the first pair of edges, orthogonally to a plane of the upper face, each of the plates having bulging parts contiguous with each of a second pair of mutually opposed edges of the upper face, a direction of bulging of the bulging parts being opposite a direction in which the side walls extend along the first pair of edges, the pair of rectangular plates being joined together at longitudinal edges of the side walls to form a respective one of the flat tubes in which the side walls the plates constitute side walls of the flat tube;

wherein the bulging parts at each of the second pair of edges comprise:

respective portions at ends of the edge of the second pair which are wider in a direction parallel to the side walls; and a portion between and contiguous with the wider portions and which is narrower in the direction parallel to the side walls;

wherein the plurality of flat tubes is arranged as a stack of the plates with the first pairs and second pairs of mutually opposed edges of the plates in alignment;

a casing in which the stack of flat tubes is arranged, wherein the casing is comprised of casing side walls overlying the side walls of the flat tubes and casing upper and lower walls overlying, respectively, an upper wall of the uppermost flat tube and a lower wall of the lowermost flat tube in the stack;

a pair of like flames each received over an outer periphery of a respective edge portion of the stack comprised of exposed edges of the bulging parts, wherein each of the frames comprises:

a peripheral flange portion having an inner periphery configured to match and be received over the outer periphery of said respective edge portion of the stack; and a peripheral packing holding portion formed at an inner edge of the flange portion and extending away from the flange portion orthogonally to said respective edge portion of the stack; and wherein at each of open ends of the casing an annular groove configured to hold a packing to provide a seal is formed between the packing holding portion of the frame and edges of the casing at the open end of the casing; and wherein the heat exchanger core without a header plate further comprises:

on the upper face of each of the stacked flat plates and between and parallel to the second pair of opposed edges, a partition of same height as height of the bulging portions, wherein the partition extends to only one of the side walls and terminates before reaching the other of the side walls thereby to form a path for flow of a fluid in a U-shape through the flat tube; and respective first and second fitting structures associated with first and second side walls of each of the flat tubes, the first and second fitting structures being of different configurations so that the flat tubes are stackable only when like fitting structures are aligned.

4. The heat exchanger core without a header plate according to claim 3, wherein:

the first fitting structure comprises a segment of the first side wall configured as an M-shaped protrusion in plan view; and the second fitting structure comprises a segment of the second side wall in an outwardly bowed configuration in plan view.

5. A heat exchanger core without a header plate comprising:

a plurality of like flat tubes, wherein each of the flat tubes is comprised of a pair of like rectangular plates, each of the plates having an upper face, the upper face being predominantly planar and configured for flow of a fluid, each of the plates having a pair of side walls only at each of a first pair of mutually opposed edges of the upper face, the side walls extending along the first pair of edges, orthogonally to a plane of the upper face, each of the plates having bulging parts contiguous with each of a second pair of mutually opposed edges of the upper face, a direction of bulging of the bulging parts being opposite a direction in which the side walls extend along the first pair of edges, the pair of rectangular plates being joined together at longitudinal edges of the side walls to form a respective one of the flat tubes in which the side walls of the plates constitute side walls of the flat tube;

wherein the bulging parts at each of the second pair of edges comprise:

respective portions at ends of the edge of the second pair which are wider in a direction parallel to the side walls; and a portion between and contiguous with the wider portions and which is narrower in the direction parallel to the side walls;

wherein the plurality of flat tubes is arranged as a stack of the plates with the first pairs and second pairs of mutually opposed edges of the plates in alignment;

a casing in which the stack of flat tubes is arranged, wherein the casing is comprised of casing side walls overlying the side walls of the flat tubes and casing upper and lower walls overlying, respectively, an upper wall of the uppermost flat tube and a lower wall of the lowermost flat tube in the stack;

a pair of like frames each received over an outer periphery of a respective edge portion of the stack comprised of exposed edges of the bulging parts, wherein each of the frames comprises:

a peripheral flange portion having an inner periphery configured to match and be received over the outer periphery of said respective edge portion of the stack; and a peripheral packing holding portion formed at an inner edge of the flange portion and extending away from the flange portion orthogonally to said respective edge portion of the stack; and wherein, at each of open ends of the casing an annular groove configured to hold a packing to provide a seal is formed between the packing holding portion of the frame and edges of the casing at the open end of the casing; and wherein the heat exchanger core without a header plate further comprises:

at least one convex portion formed on an inner periphery of the flange portion of the frame each of which convex portion extends in a direction orthogonal to the sidewalls or orthogonal to upper and lower walls of the flat tubes and configured to engage an outer peripheral portion of the stack thereby to fix the frame on the stack.

6. A heat exchanger core without a header comprising:

a plurality of like flat tubes, wherein each of the flat tubes is comprised of a pair of like rectangular plates, each of the plates having an upper face, the upper face being predominantly planar and configured for flow of a fluid, each of the plates having a pair of side walls only at each of a first pair of mutually opposed edges of the upper face, the side walls extending along the first pair of edges, orthogonally to a plane of the upper face, each of the plates having bulging parts contiguous with each of a second pair of mutually opposed edges of the upper face, a direction of bulging of the bulging parts being opposite a direction in which the side walls extend along the first pair of edges, the pair of rectangular plates being joined together at longitudinal edges of the side walls to form a respective one of the flat tubes in which the side walls of the plates constitute side walls of the flat tube;

wherein the bulging parts at each of the second pair of edges comprise:

respective portions at ends of the edge of the second pair which are wider in a direction parallel to the side walls; and a portion between and contiguous with the wider portions and which is narrower in the direction parallel to the side walls;

wherein the plurality of flat tubes is arranged as a stack of the plates with the first pairs and second pairs of mutually opposed edges of the plates in alignment;

a casing in which the stack of flat tubes is arranged, wherein the casing is comprised of casing side walls overlying the side walls of the flat tubes and casing upper and lower walls overlying, respectively, an upper wall of the uppermost flat tube and a lower wall of the lowermost flat tube in the stack;

a pair of like frames each received over an outer periphery of a respective edge portion of the stack comprised of exposed edges of the bulging parts, wherein each of the frames comprises:

a peripheral flange portion having an inner periphery configured to match and be received over the outer periphery of said respective edge portion of the stack; and a peripheral packing holding portion formed at an inner edge of the flange portion and extending away from the flange portion orthogonally to said respective edge portion of the stack; and wherein, at each of open ends of the casing an annular groove configured to hold a packing to provide a seal is formed between the packing holding portion of the frame and edges of the easing at the open end of the casing; and wherein the heat exchanger core without a header plate further comprises:

tongue piece portions of the bulging portions protruding in the direction parallel to the side walls from tips of both end portions of each of the bulging portions of each of the plates so that a tip of each of the tongue piece portions abuts on an inside of the flange portion to thereby form room between the bulging portion and the inside flange portion and provide a path configured to conduct a second fluid to an open end of each of the flat tubes.

7. The heat exchanger core without a header plate according to claim 6, further comprising:

a middle protruding portion of the bulging portions of each of the plates protruding, in the direction parallel to the side walls, from a middle portion of each of the edges at which a respective one of the bulging parts is formed so that a tip of the middle protruding portion abuts on an inside of the flange portion.

8. The heat exchanger core without a header plate according to claim 6, further comprising:

at least one convex portion formed on an inner periphery of the flange portion of the frame and extending in a direction orthogonal to the sidewalls and configured to engage an outer peripheral portion of the stack thereby to fix the frame on the stack, wherein the at least one convex portion is parallel to and coextensive with middle portions of the bulging portions of the plates.

9. A heat exchanger core without a header plate comprising:

a plurality of like flat tubes, wherein each of the flat tubes is comprised of a pair of like rectangular plates, each of the plates having an upper face, the upper face being predominantly planar and configured for flow of a fluid, each of the plates having a pair of side walls only at each of a first pair of mutually opposed edges of the upper face, the side walls extending along the first pair of edges, orthogonally to a plane of the upper face, each of the plates having bulging parts contiguous with each of a second pair of mutually opposed edges of the upper face, a direction of bulging of the bulging parts being opposite a direction in which the side walls extend along the first pair of edges, the pair of rectangular plates being joined together at longitudinal edges of the side walls to form a respective one of the flat tubes in which the side walls the plates constitute side walls of the flat tube;

wherein the bulging parts at each of the second pair of edges comprise:

respective portions at ends of the edge of the second pair which are wider in a direction parallel to the side walls; and a portion between and contiguous with the wider portions and which is narrower in the direction parallel to the side walls;

wherein the plurality of flat tubes is arranged as a stack of the plates with the first pairs and second pairs of mutually opposed edges of the plates in alignment;

a casing in which the stack of flat tubes is arranged, wherein the casing is comprised of casing side walls overlying the side walls of the flat tubes and casing upper and lower walls overlying, respectively, an upper wall of the uppermost flat tube and a lower wall of the lowermost flat tube in the stack;

a pair of like flames each received over an outer periphery of a respective edge portion of the stack comprised of exposed edges of the bulging parts, wherein each of the frames comprises:

a peripheral flange portion having an inner periphery configured to match and be received over the outer periphery of said respective edge portion of the stack; and a peripheral packing holding portion formed at an inner edge of the flange portion and extending away from the flange portion orthogonally to said respective edge portion of the stack; and wherein at each of open ends of the casing an annular groove configured to hold a packing to provide a seal is formed between the packing holding portion of the frame and edges of the casing at the open end of the casing; and wherein each of open end portions of the casing is of expanded width and height relative to the rest of the casing so that each expanded open end portion is received on an outer periphery of a respective one of the frames and the rest of the casing is so configured that height of a space between an inner face of the casing and the upper wall of the uppermost flat tube of the stack is the same as thickness of a wall of the peripheral flange portion of the frame.

10. A heat exchanger core without a header plate, comprising:

a plurality of like flat tubes, wherein each of the flat tubes is comprised of a pair of like rectangular plates, each of the plates having an upper face, the upper face being predominantly planar and configured for flow of a fluid, each of the plates having a pair of side walls only at each of a first pair of mutually opposed edges of the upper face, the side walls extending along the first pair of edges, orthogonally to a plane of the upper face, each of the plates having bulging parts contiguous with each of a second pair of mutually opposed edges of the upper face, a direction of bulging of the bulging parts being opposite a direction in which the side walls extend along the first pair of edges, the pair of rectangular plates being joined together at longitudinal edges of the side walls to form a respective one of the flat tubes in which the side walls of the plates constitute side walls of the flat tube;

wherein the plurality of flat tubes is arranged as a stack of the plates with the first pairs and second pairs of mutually opposed edges in alignment;

a casing in which the stack of flat tubes is arranged, wherein the casing is comprised of casing side walls overlying the side walls of the flat tubes and casing upper and lower walls overlying, respectively, an upper wall of the uppermost flat tube and a lower wall of the lowermost flat tube in the stack;

a pair of like frames each received over an outer periphery of a respective edge portion of the stack comprised of exposed edges of the bulging parts, wherein each of the frames comprises:

a peripheral flange portion having an inner periphery configured to match and be received over the outer periphery of said respective edge portion of the stack; and a peripheral packing holding portion formed at an inner edge of the flange portion and extending away from the flange portion orthogonally to said respective edge portion of the stack; and wherein, at each of open ends of the casing an annular groove configured to hold a packing to provide a seal is comprised of the packing holding portion of the frame and edges of the casing at the open end of the casing, the annular groove also being configured to receive peripheral edges of a tank for abutment against a packing held in the annular groove.

11. The heat exchanger core according to claim 10, wherein the heat exchanger core, as an assembled unit, is brazed in a furnace to form an integral unit.

* * * * *